US005826723A

United States Patent [19]

Jaszai

[11] Patent Number: 5,826,723

[45] Date of Patent: Oct. 27, 1998

[54] IMPACT RESISTANT WRAPPING SYSTEM

[75] Inventor: Zoltan Kazmer Jaszai, Minato-ku, Japan

[73] Assignee: Burlington Consolidated Limited Incorporation, Dublin, Ireland

[21] Appl. No.: 632,401

[22] PCT Filed: Oct. 28, 1994

[86] PCT No.: PCT/JP94/01826

§ 371 Date: Apr. 17, 1996

§ 102(e) Date: Apr. 17, 1996

[87] PCT Pub. No.: WO95/11838

PCT Pub. Date: May 4, 1995

[30] Foreign Application Priority Data

Oct. 28, 1993 [JP] Japan ..... 5-271066

[51] Int. Cl.[6] ..... B65D 81/00

[52] U.S. Cl. ..... 206/522; 383/3

[58] Field of Search ..... 383/3; 206/521, 206/522

[56] References Cited

U.S. PATENT DOCUMENTS 3,366,231 1/1968 Trakas ..... 206/522

3,634,970 1/1972 Williams ..... 206/522 X 5,263,587 11/1993 Elkin et al. ..... 206/522

5,340,632 8/1994 Chappuis ..... 206/522 X

*Primary Examiner*—Jacob K. Ackun

*Attorney, Agent, or Firm*—Wenderoth, Lind & Ponack, L.L.P.

[57] ABSTRACT

An impact resistant wrapping system of the invention has a sheetlike wrapping body (1) formed of gas-barrier flexible wall members (11) and (12) between which wall chambers (14) closely partitioned or partially joined to one another are formed. The sheetlike wrapping body (1) is provided with an intake tap (3) capable of injecting gas into the wall chambers and exhaust taps (5) for releasing the gas from the wall chambers (14), which intake and exhaust taps are integrated so as to be used in common or formed separately. The exhaust taps (5) are arranged between the closely partitioned wall chambers (14) in one line or two or more lines intersecting to the wall chambers (14) so that the adjacent wall chambers (14) communicate with one another through the exhaust taps (5), thereby allowing the exhaust tap (5) of the outermost wall chamber (14) to communicate to the outside of the sheetlike wrapping body (1).

20 Claims, 27 Drawing Sheets

IMPACT RESISTANT WRAPPING SYSTEM

TECHNICAL FIELD

This invention relates to an impact resistant wrapping system. More particularly, this invention relates to an improvement in versatility and repetitious usability of such an impact resistant wrapping system capable of forming an impact resistant chamber inflatable with gas around an article to be protected.

BACKGROUND ART

There have been so far known wrapping implements having an impact resistant chamber inflatable with gas as described in, for example, Japanese Utility Model Application Public Disclosure No. HEI 4-3974(A).

This conventional impact resistant wrapping system comprises gas-barrier flexible wall members between which partitioned wall chambers are formed, and a check valve for introducing air into the wall chambers. The wrapping system is affixed to the inner surface of a packing case in use. Before or after putting the article to be protected into the packing case, the air is injected into the wall chambers through the check valve so as to form a shock-absorbing space with which a gap between the packing case and the article is filled in.

The aforementioned prior art impact resistant wrapping system has suffered disadvantages such that it invariably calls for a packing case because it must be integrally united to the packing case in use, and cannot protect an article which is notably different in shape from the packing case and thus is not versatile. Furthermore, since the conventional wrapping system is bonded to the packing case and is not furnished with an effective means for releasing the air from the wall chambers, it is difficult to reuse.

This invention was made in view of the foregoing problems and has the object of providing an impact resistant wrapping system having high versatility and repetitious usability and capable of repeatedly wrapping articles of various shapes and sizes.

SUMMARY OF THE INVENTION

To solve the problems as described above, according to the present invention, there is provided an impact resistant wrapping system possessing the following:

That is, the impact resistant wrapping system according to this invention comprises a sheetlike wrapping body formed of gas-barrier flexible wall members which are closely partitioned or partially joined to one another. The sheetlike wrapping body is provided with an intake tap capable of injecting gas into the wall chambers and exhaust taps for releasing the gas from the wall chambers. The intake and exhaust taps are integrated so as to be used in common or formed separately. The exhaust taps are arranged between the closely partitioned wall chambers in one line or two or more lines intersecting to the wall chambers so that the adjacent wall chambers communicate with one another through the exhaust taps, thereby allowing the exhaust tap of the outermost wall chamber to communicate to the outside of the sheetlike wrapping body. Also, the exhaust tap in the aforesaid wrapping system may be formed of a flat cylinder made of thin synthetic resin film.

Furthermore, an exhaust pipe, which is provided in its peripheral surface with a number of pores and can be inserted successively into the exhaust taps, may be used.

Moreover, the impact resistant wrapping system according to this invention comprises a sheetlike wrapping body formed of gas-barrier flexible wall members between which partitioned wall chambers are formed so as to partially communicate with a plurality of passages. The sheetlike wrapping body is provided with an intake tap capable of injecting gas into the wall chambers and exhaust taps for releasing the gas out of the wall chambers. The intake and exhaust taps are integrated so as to be used in common or formed separately. The wrapping body is provided with intermediary taps disposed between the closely partitioned wall chambers, thereby allowing the exhaust tap of the outermost wall chamber to communicate to the outside of the sheetlike wrapping body through the plurality of passages.

According to the aforementioned structure, the wall chamber in the sheetlike wrapping body is inflated with gas injected through the intake tap to form a shock-absorbing space. Since the wall chamber in the sheetlike wrapping body is subdivided into smaller chambers, the wrapping body can be folded or bent so as to protect the articles of various shapes or sizes. The gas injected in the wall chambers can easily be released continuously by inserting the exhaust pipe through the exhaust taps arranged in line. Since the sheetlike wrapping body is deflated into a flat shape by releasing the gas out of the wall chambers, it can be used repeatedly.

DETAILED DESCRIPTION OF THE PREFERRED EMBODIMENTS

Embodiments of the impact resistant wrapping system according to this invention will be described hereinafter with reference to the accompanying drawings. FIG. 1 through FIG. 8 illustrate a first embodiment of the impact resistant wrapping system according to this invention.

Figure 1:
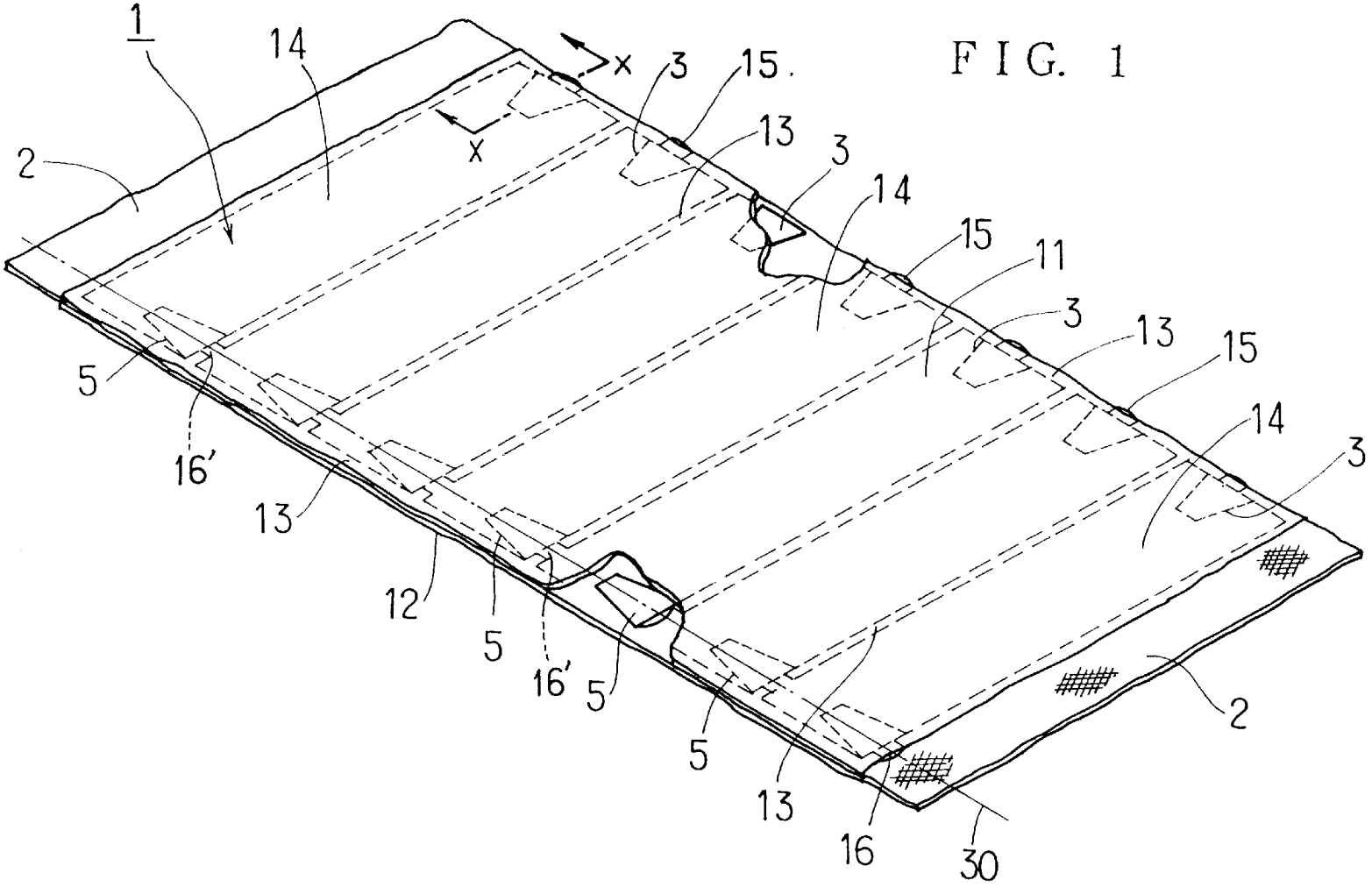
FIG. 1 is a partial cutaway perspective view showing a first embodiment of the impact resistant wrapping system according to this invention.

As shown in FIG. 1, a sheetlike wrapping body 1 in this embodiment is formed by putting two rectangular flexible wall members 11 and 12 one on top of the other and sealing, with an adhesive or by thermal welding, the four peripheral sides and portions which are parallel to two of the aforesaid four sides and spaced at regular intervals to thereby form seal portions 13. Thus, there are definitely partitioned rectangular wall chambers 14 among the seal portions 13 between the flexible wall members 11 and 12. The flexible wall members 11 and 12 have gas-barrier properties such as impermeability to gases or extremely low gas permeability as well as moderate flexibility to enable the wrapping body to be elastically deformed, conforming to the shape of an article 20 to be wrapped. The flexible wall member may be formed of a monolayered synthetic resin film, multilayered synthetic resin film or material laminated with a metal film. The flexible wall members 11 and 12 preferably have magnetic-resistant and antistatic properties. Incidentally, in case that the monolayered or multilayered synthetic resin film is used as the flexible wall members 11 and 12, it is preferable to use a film of 0.02 to 0.50 mm in thickness.

Onto the opposite short sides of the sheetlike wrapping body 1, a connecting means 2 composed of band-shaped male and female velvet fasteners are affixed.

Figure 2:
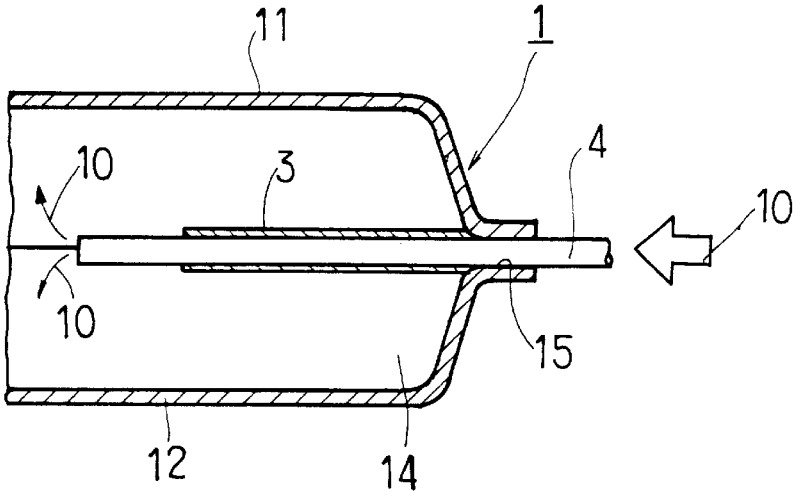
FIG. 2 is an enlarged section taken on line 2—2 in FIG. 1, showing the state of injecting gas.
Figure 3:
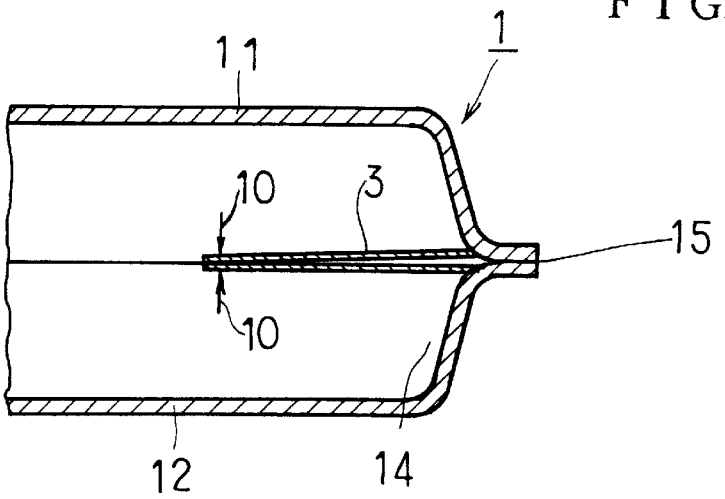
FIG. 3 is a view showing the state of confining gas.

At one of the short sides of the seal portions 13 defining each wall chamber 14 in the sheetlike wrapping body 1, an intake tap 3 is disposed. As illustrated in FIG. 2 and FIG. 3, the intake tap 3 is normally in its closed state, but opens by inserting thereinto an injection pipe 4 or any other means, so that gases 10 such as air can be injected into the wall chamber 14 of the sheetlike wrapping body 1. Thus, the intake tap is formed of a cylinder of flat synthetic resin film having a thickness of about 0.01 to 0.06 mm and is connected with an intake port 15 pierced through a part of the aforesaid seal portion 13.

Figure 8:
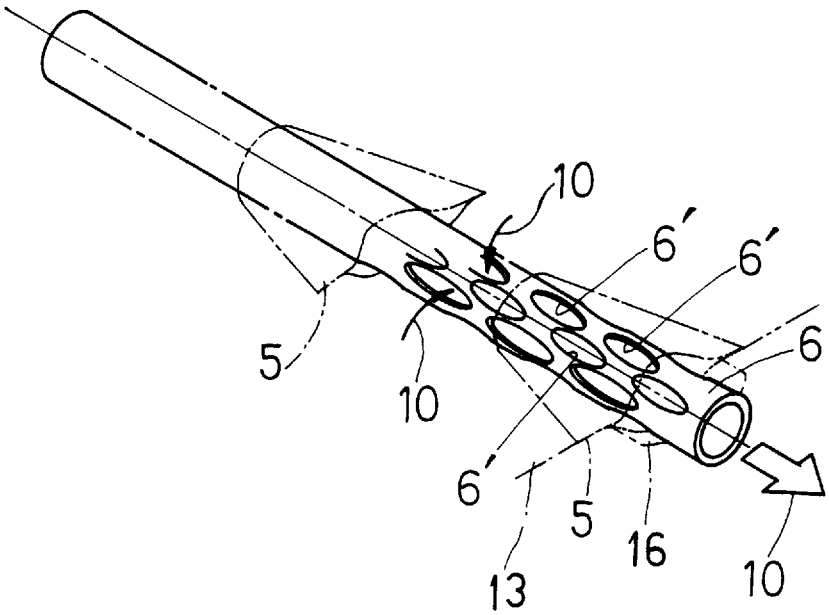
FIG. 8 is an enlarged perspective view showing the principal portion of the system of FIG. 5 or FIG. 7 in a state of releasing gas.

At one of the long sides of the seal portions 13 defining each wall chamber 14, an exhaust tap 5 is disposed. The exhaust tap 5 is made of the same material and has the same structure as those of the aforesaid intake tap 3. The exhaust tap is normally in its closed state, but is brought into an open state by inserting thereinto an exhaust pipe 6 which is provided in the peripheral surface with a number of pores 6' opening in various directions so as to release the gas filled in the wall chamber 14, as shown in FIG. 8. The exhaust taps 5 are arranged on the line 30 intersecting perpendicularly to each wall chamber 14. Furthermore, the wall chambers 14 are respectively connected with the adjacent wall chambers through the exhaust taps 5 and exhaust ports 16' pierced partially through the aforesaid seal portions 13. One of the outermost wall chambers 14 communicates with the outside of the sheetlike wrapping body 1 through an outlet port 16 pierced through a part of the outermost seal portion 13 having the exhaust tap 5. The aforesaid exhaust pipe 6 is successively inserted through the exhaust taps 5, outlet port 16 and exhaust ports 16'.

Since the whole constituent components including the intake taps 3 and exhaust taps 5 are made by simply bonding lamellar sheetlike material, the wrapping system can be easily manufactured at a low cost. Besides, since the wrapping system including the intake taps 3 and exhaust taps 5 can be made flat like a thin sheet, it is advantageous in tucking away and storing.

Figure 4:
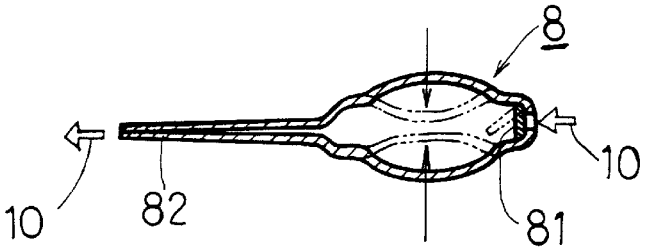
FIG. 4 is a sectional view showing one example of a tool for injecting gas into the system of FIG. 1.
Figure 5:
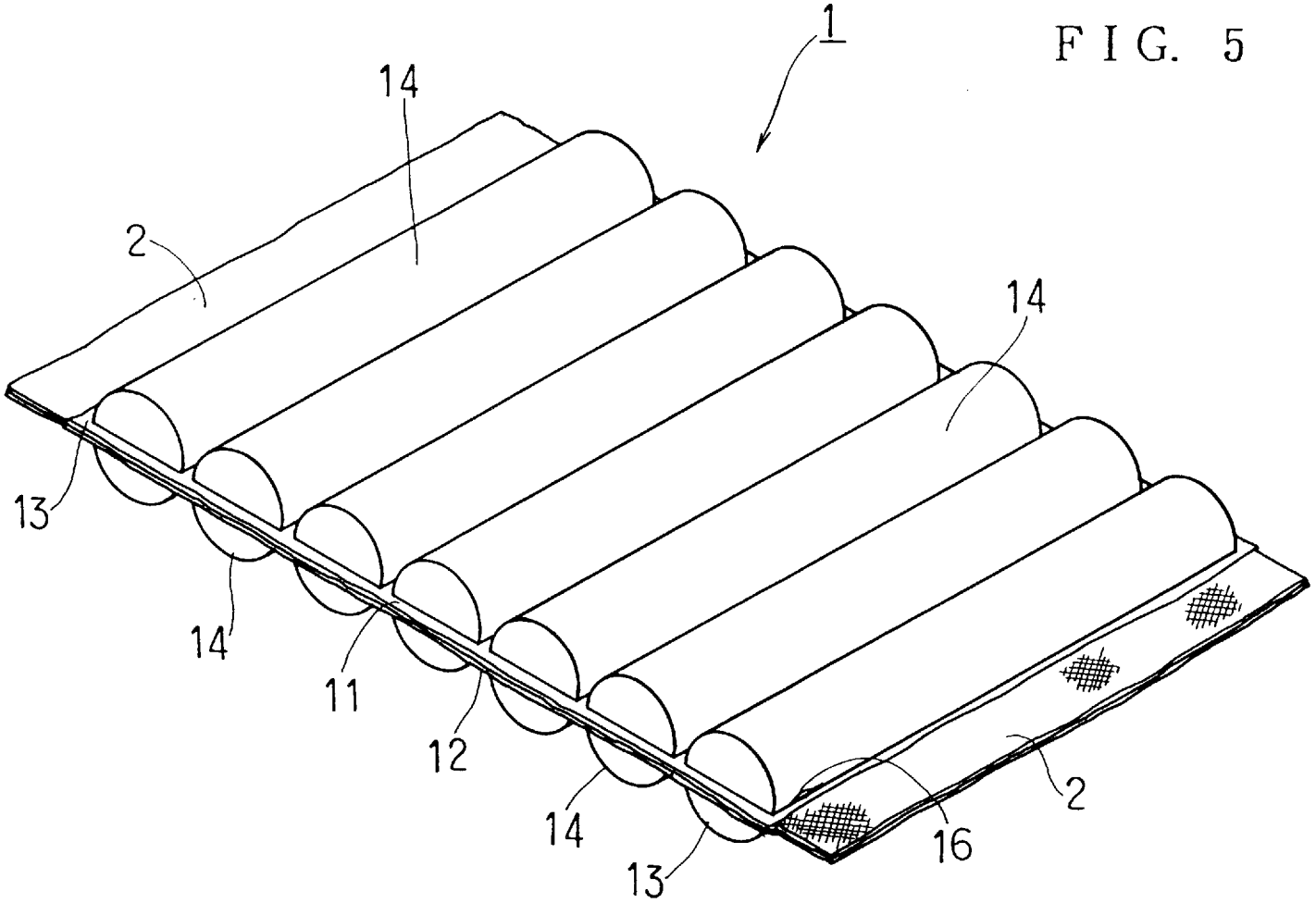
FIG. 5 is a perspective view showing the state of injecting gas into the system of FIG. 1.

When the wrapping system is used, the induction pipe 4 shown in FIG. 2 is inserted into the wall chambers 14 in the state shown in FIG. 1 through the intake port 15 and intake taps 3, so that the wall chambers 14 in the sheetlike wrapping body 1 can be inflated with a breath or by injecting gas 10 by use of an air compressor or the like, as shown in FIG. 5. Then, the article 20 to be protected is wrapped with the inflated wrapping body 1 and retained by joining together the connecting means 2. As a countermeasure, after wrapping the article 20 with the wrapping body of FIG. 1 and joining the connecting means 2, the gas 10 may be injected into the wall chambers 14 in the sheetlike wrapping body 1. It is possible to inject the gas into the wall chambers by using a compressor 8 as shown in FIG. 4 in place of the aforesaid induction pipe 4. The compressor has a simple valve 81 made of synthetic resin and a blast nozzle 82 and serves to discharge the air by being squeezed. When pulling out the induction pipe 4 after injecting the gas 10 into the wall chambers 14, the intake tap 3 assumes its flat state by the action of the pressure of the gas filled in the wall chamber, as shown in FIG. 3, thus inextricably confining the gas 10 within the wall chamber 14. The exhaust tap 5 has the same function of confining the gas 10 as the intake tap.

Figure 6:
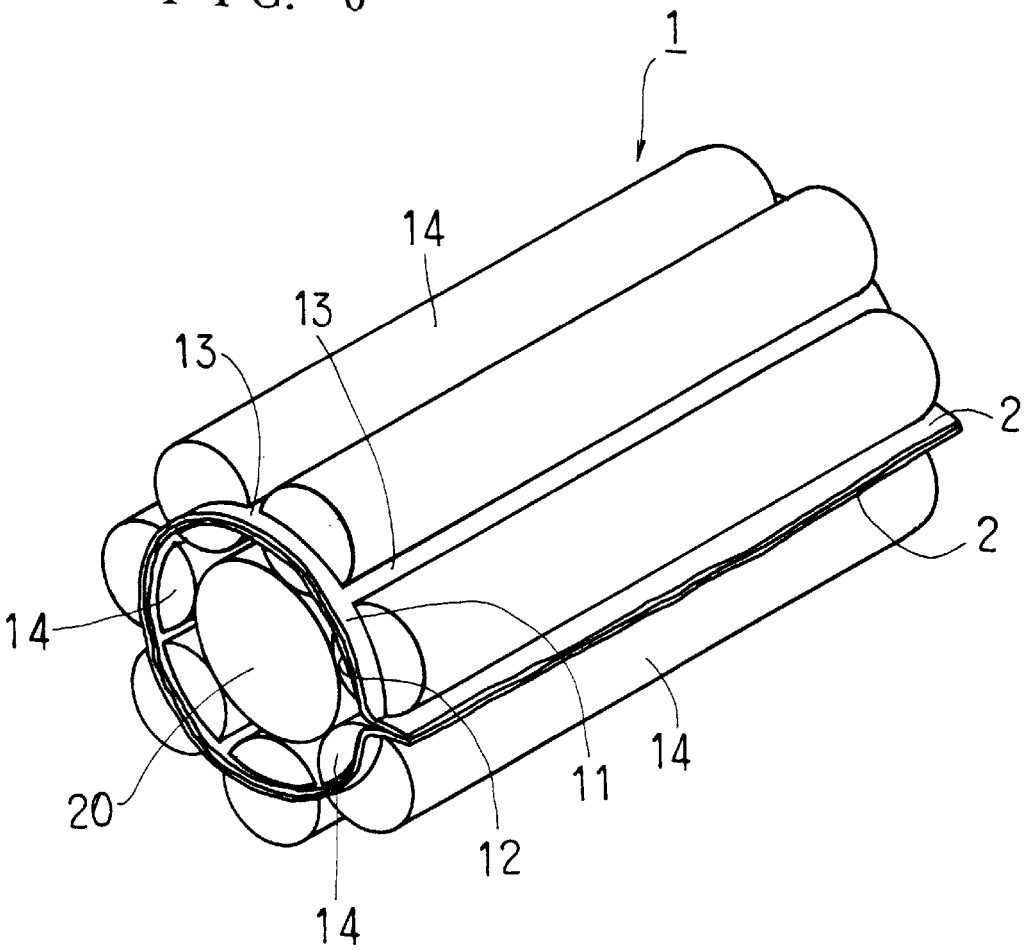
FIG. 6 is a perspective view showing a state (wrapping state) putting the system of FIG. 5 into practical use.
Figure 7:
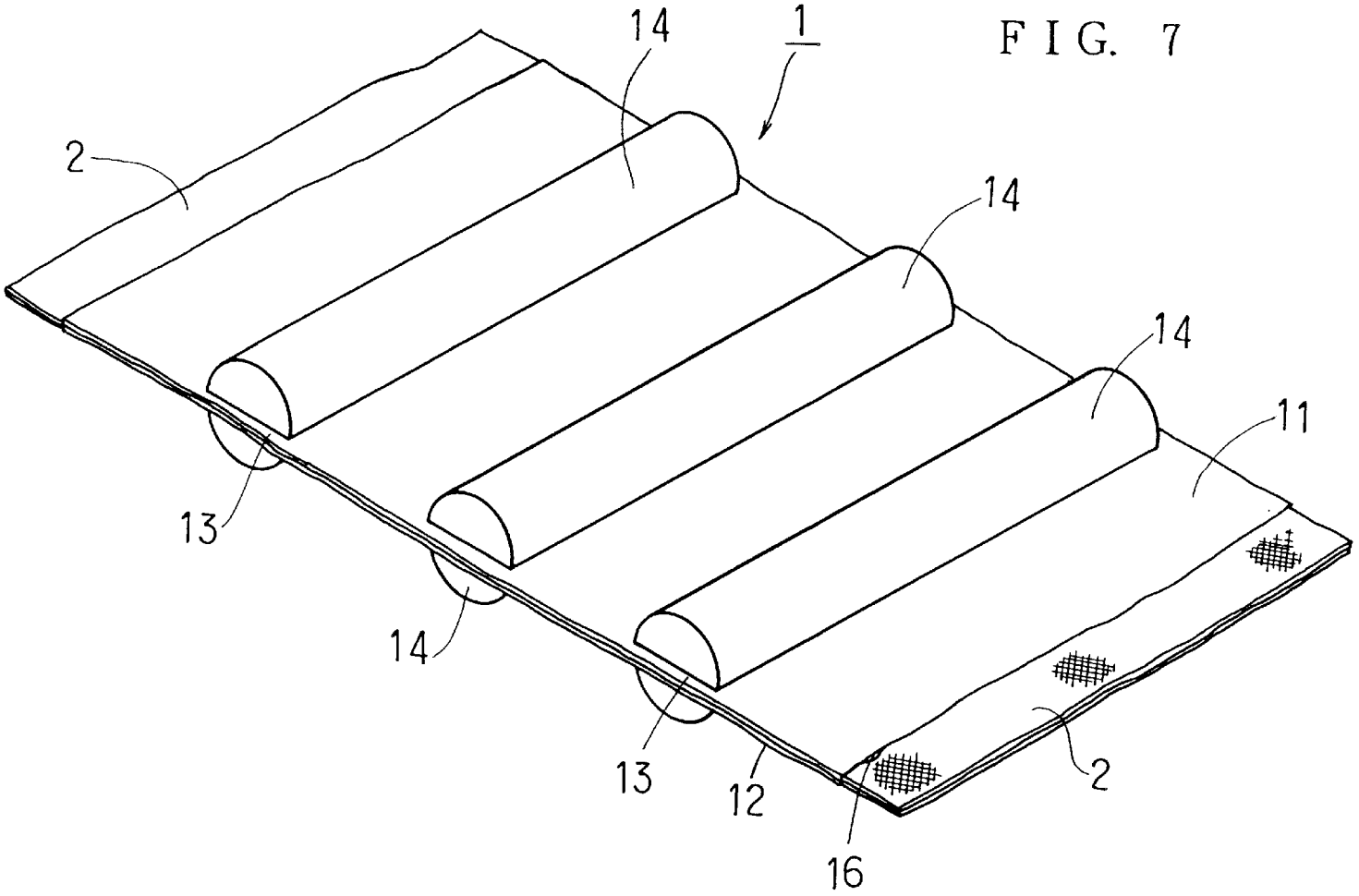
FIG. 7 is a perspective view showing the state of injecting gas in a modification of FIG. 5.

Although FIG. 6 shows the case where a columnar article 20 to be protected is wrapped, it is possible to wrap an article of any shape other than such a columnar shape, because the wall chambers 14, each formed in a long strip, are arranged side by side so as to be freely folded or bent even in the deflated or inflated state. Moreover, some of the wall chambers 14 may be selectively inflated in use as shown in FIG. 7.

The article 20 surrounded by the inflated sheetlike wrapping body 1 can be fully protected by the gas 10 filled in the wall chambers 14 in the sheetlike wrapping body 1, because the gas in the inflated wall chambers serves to absorb shocks. Particularly, since the wall chambers 14 are closely partitioned, even when one of the wall chambers 14 is broken to permit the gas in the wall chamber to escape, the shock-absorbing function of the other wall chambers 14 of the wrapping system is not affected by the leakage of gas.

When the article 20 needs to be unpacked, the connecting means 2 are unfastened to free the article 20. Then, the exhaust pipe 6 is inserted into the wall chambers 14 through the outlet port 16 as shown in FIG. 8, so as to permit the gas 10 in the wall chambers 14 to spontaneously escape out of the sheetlike wrapping body 1 by its own pressure. Around the end of releasing the gas 10, external pressure may be exerted to each wall chamber 14 to increase the inner pressure in the wrapping body. Since the exhaust pipe 6 has many pores 6' opening in all directions, the gas 10 can be smoothly released without controlling the state of inserting the exhaust pipe 6 into the wall chambers.

When the gas 10 is released from the wall chambers 14 of the sheetlike wrapping body 1, the sheetlike wrapping body assumes its flat state, so that it can be arbitrarily reused.

Figure 9:
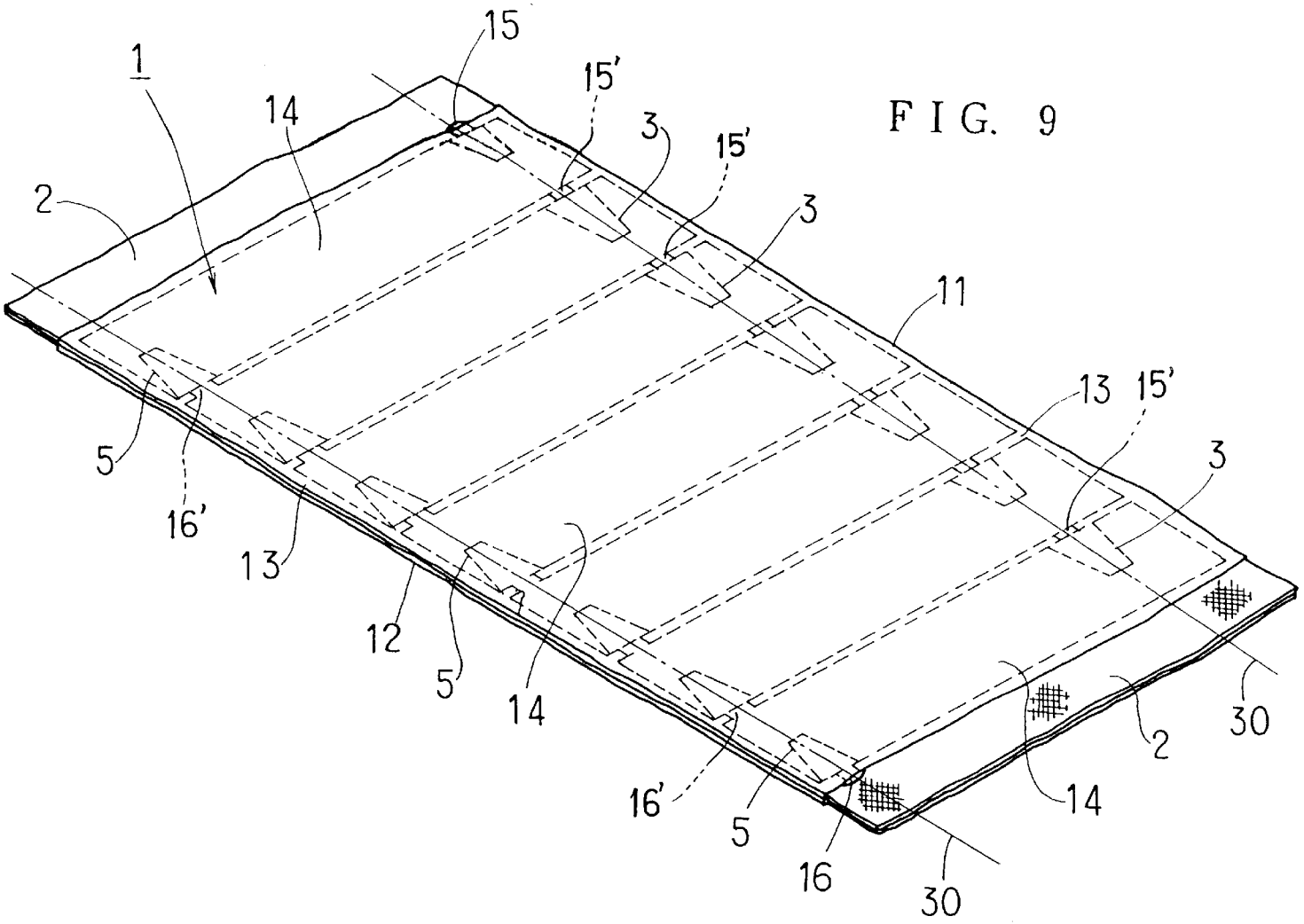
FIG. 9 is a perspective view of a second embodiment of the impact resistant wrapping system according to this invention.

FIG. 9 shows a second embodiment of the impact resistant wrapping system according to this invention. In this embodiment, the intake taps 3 in the aforementioned first embodiment are arranged in a similar manner to the exhaust tap 5 on the line 30, but in the opposite direction. Each intake tap 3 is provided with an intake port 15' pierced partially the seal portion 13.

According to this embodiment, the exhaust pipe 6 can be continuously inserted into the intake taps 3, so that the gas 10 can be simultaneously introduced into the wall chambers 14. Furthermore, since the intake taps 3 and the exhaust taps 5 are arranged in the same manner, the system of this embodiment can be readily produced.

Figure 10:
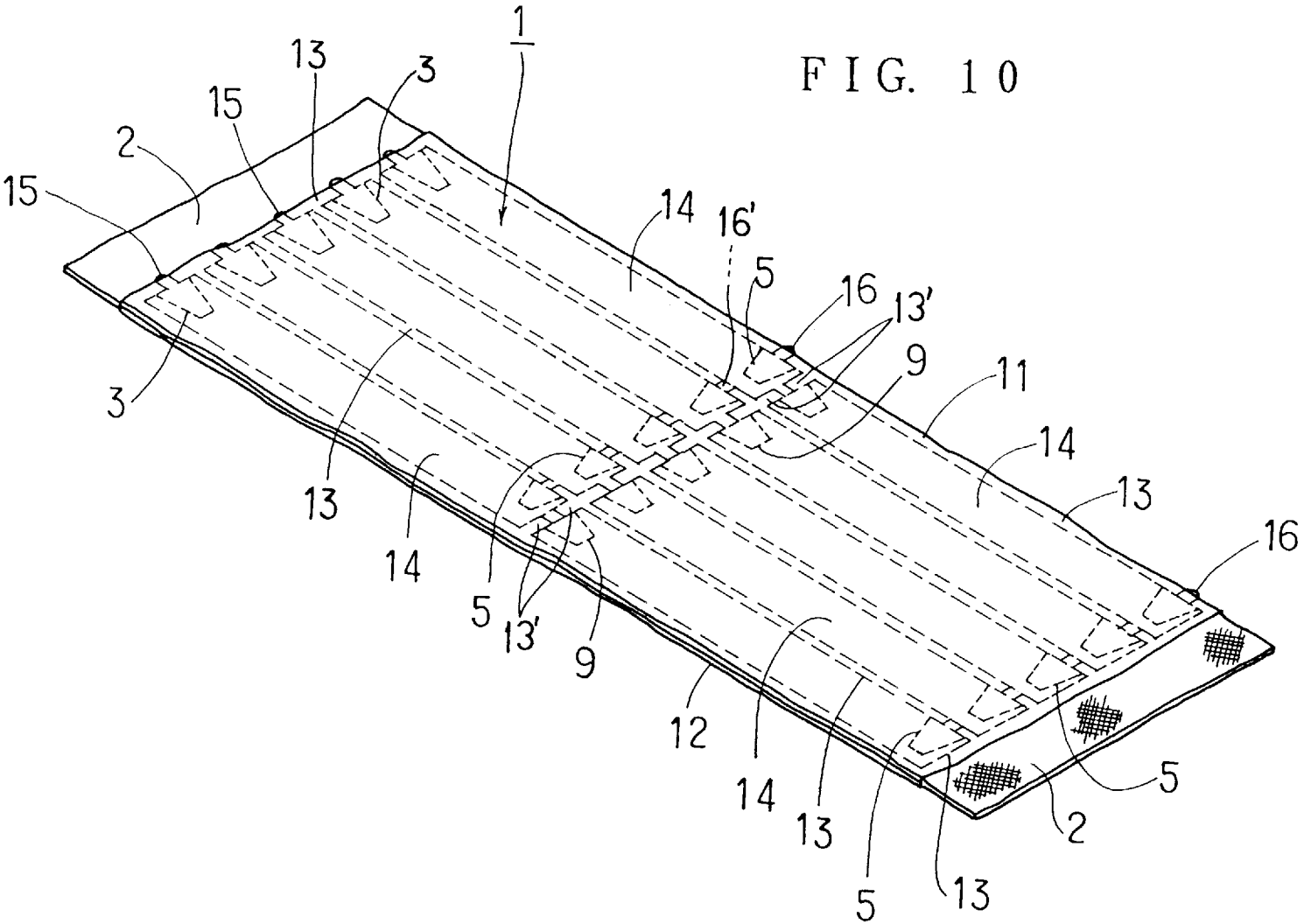
FIG. 10 is a perspective view of a third embodiment of the impact resistant wrapping system according to this invention.
Figure 11:
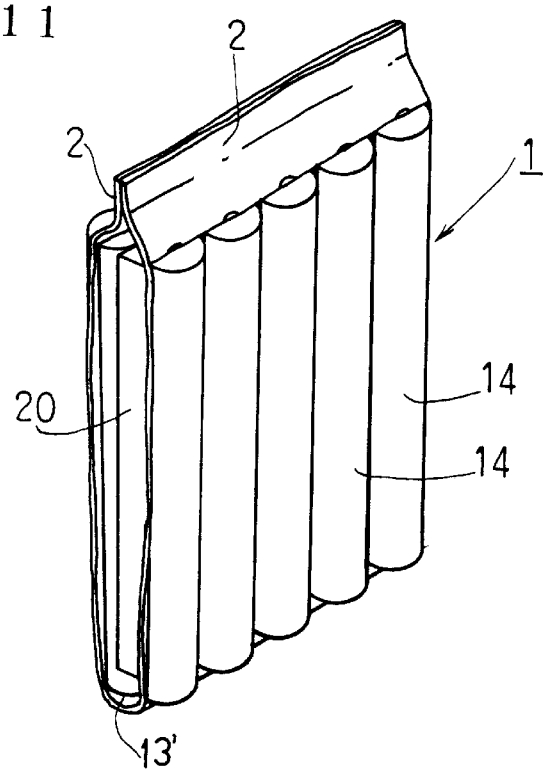
FIG. 11 is a perspective view of the system of FIG. 10 in use.

FIG. 10 and FIG. 11 show a third embodiment of the impact resistant wrapping system according to this invention. In this embodiment, the wall chambers 14 extending in the longitudinal direction of the sheetlike wrapping body 1 are divided by the seal portion 13' perpendicular to the longitudinal direction. The divided wall chambers 14 are connected via intermediary taps 9 similar to the intake tap 3 and exhaust tap 5.

This embodiment can be suitably used for wrapping a flat article 20 in such a manner that the wrapping body is doubled along the divided line (seal portion 13') so as to hold the article therebetween.

Figure 12:
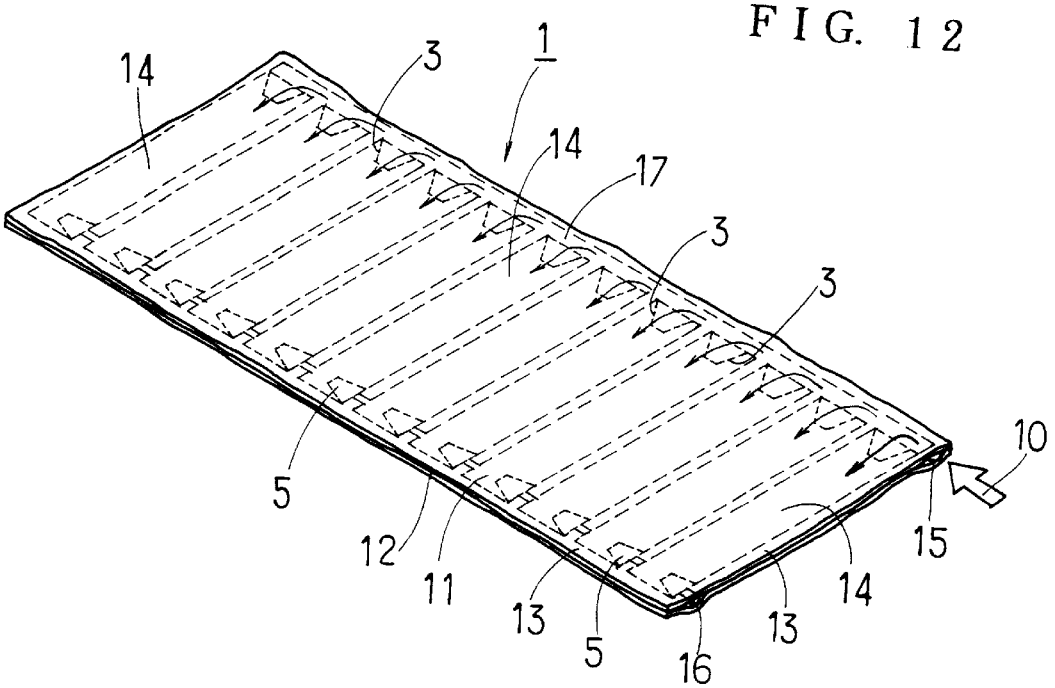
FIG. 12 is a perspective view of a fourth embodiment of the impact resistant wrapping system according to this invention.

FIG. 12 shows the fourth embodiment of the impact resistant wrapping system according to this invention, wherein an intake passage 17 having one intake port 15 confronts the intake taps 3 disposed in the wall chambers in the sheetlike wrapping body 1.

According to this embodiment, gas 10 can be introduced into the wall chambers 14 through the intake port 15 and the intake taps 3 at one time, but need not be introduced individually into the wall chamber in the sheetlike wrapping body 1.

Figure 13:
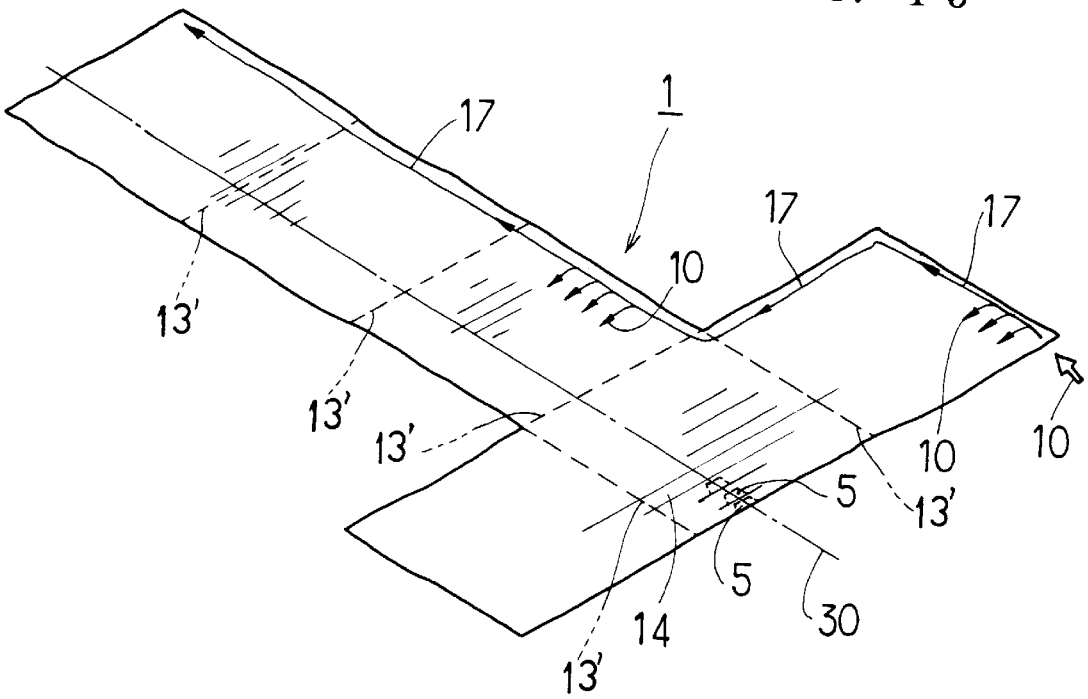
FIG. 13 is a perspective view of a fifth embodiment of the impact resistant wrapping system according to this invention.
Figure 14:
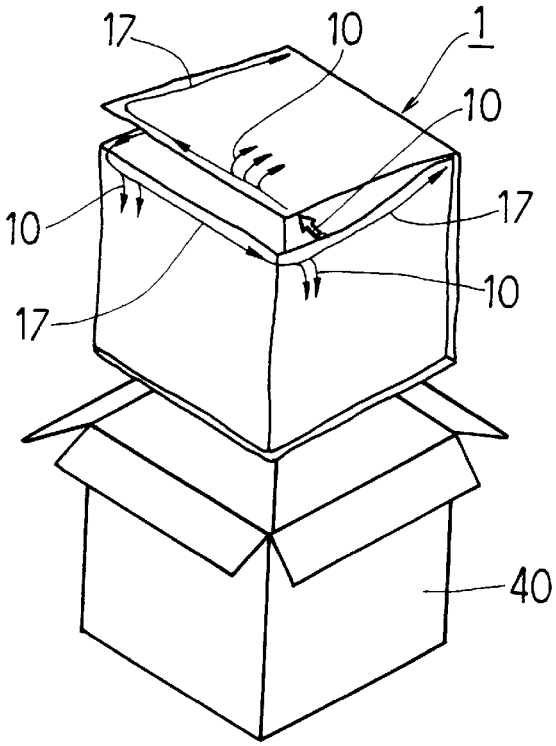
FIG. 14 is a perspective view of the system of FIG. 13 in use.

FIG. 13 and FIG. 14 show a fifth embodiment of the impact resistant wrapping system according to this invention. In this embodiment, the sheetlike wrapping body 1 as used in the foregoing second embodiment is formed in a T-shape foldable into a hexahedron so as to be placed within a container box 40. This wrapping body has also the intake passage 17 as seen in the aforementioned fourth embodiment.

This embodiment can be used in the conventional manner as illustrated in FIG. 14.

Figure 15:
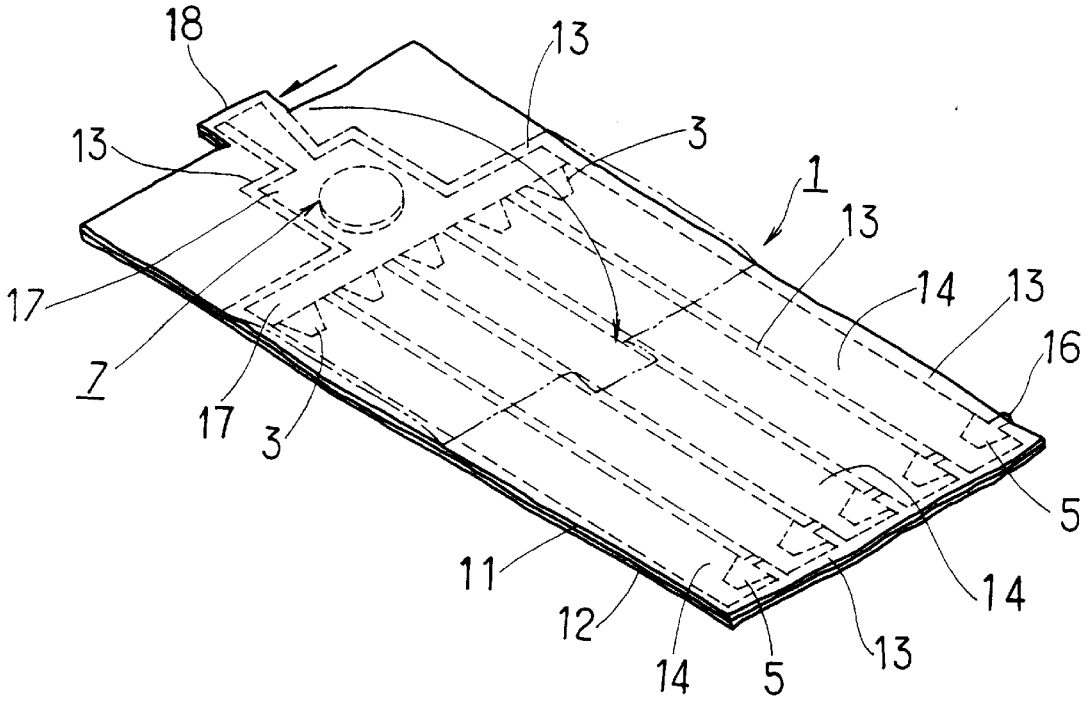
FIG. 15 is a perspective view of a sixth embodiment of the impact resistant wrapping system according to this invention.
Figure 16:
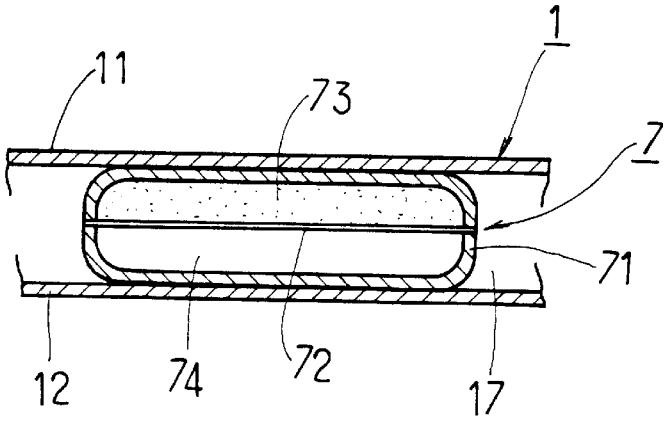
FIG. 16 is an enlarged perspective view showing a principal portion of the system of FIG. 15.

FIG. 15 and FIG. 16 show a sixth embodiment of the impact resistant wrapping system according to this invention. In this embodiment, instead of the intake port 15 as described above, a protruding piece 18 having a gas capsule 7 contained in the intake passage 17 is formed.

The gas capsule 7 has a partition membrane 72 for partitioning the inside of a shell 71 into two parts for separately containing a liquid or solid substance 73 and another substance 74. By pressing the gas capsule to break the partition membrane 72, both the substances 73 and 74 are mixed with each other to react chemically and generate gas. For example, in order to generate oxygen as the gas, there may be used manganese oxide as the substance 73 and a hydrogen peroxide solution as the substance 74. As a countermeasure, it is desirable to use, as the substance 73, various solid substances obtained by bonding soluble derivatives with gas, which have been recently used for a chemical experiment, horticulture gardening and aquarium. In this case, water may be used as the other substance 74. However, it is preferable to use the substances 73 and 74 capable of chemically interacting without generating a high temperature and damaging the shell 71. Furthermore, the shell 71 may be made of a synthetic resin material having labyrinthian fine pores which allow the gases to pass therethrough, but prevent liquid components from leaking out of the shell 71.

According to this embodiment, when the wrapping system is first used, the wall chambers 14 in the sheetlike wrapping body 1 can be inflated with the gas 10 generated from the gas capsule 7 without need to supply the gas 10 into the wall chambers in the same manner as the foregoing embodiments. When reusing the wrapping system two or more times, the protruding piece 18 is cut to form the intake port 15 so as to introduce the gas into the wall chambers in the same manner as the foregoing embodiments. In and after the second use, the part accommodating the gas capsule 7, which becomes unserviceable, may be folded back upon the sheetlike wrapping body 1 having the wall chambers 14.

Figure 17:
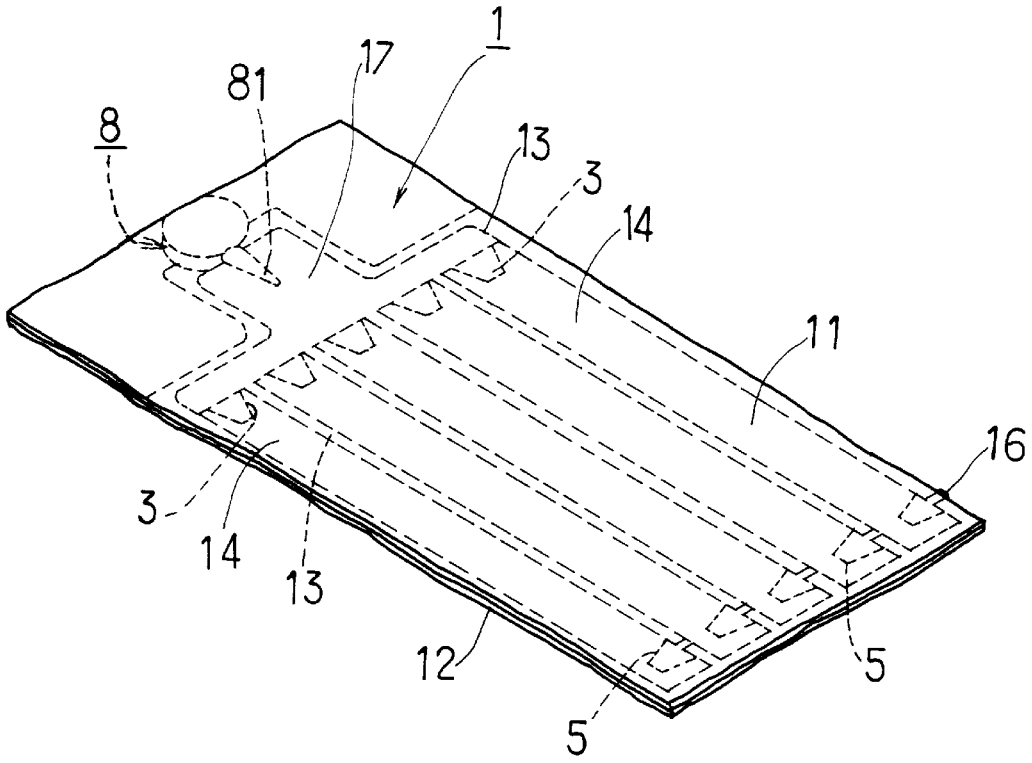
FIG. 17 is a perspective view of a seventh embodiment of the impact resistant wrapping system according to this invention.

FIG. 17 shows a seventh embodiment of the impact resistant wrapping system according to this invention. In this embodiment, the compressor 8 shown in FIG. 4 having the function of the intake port 15 is integrated into the wrapping body in place of the gas capsule 7 seen in the foregoing sixth embodiment.

This embodiment makes it possible to repeatedly inject the gas 10 into the wall chambers by use of the compressor 8 and simplify the structure in comparison with the aforementioned sixth embodiment.

Figure 18:
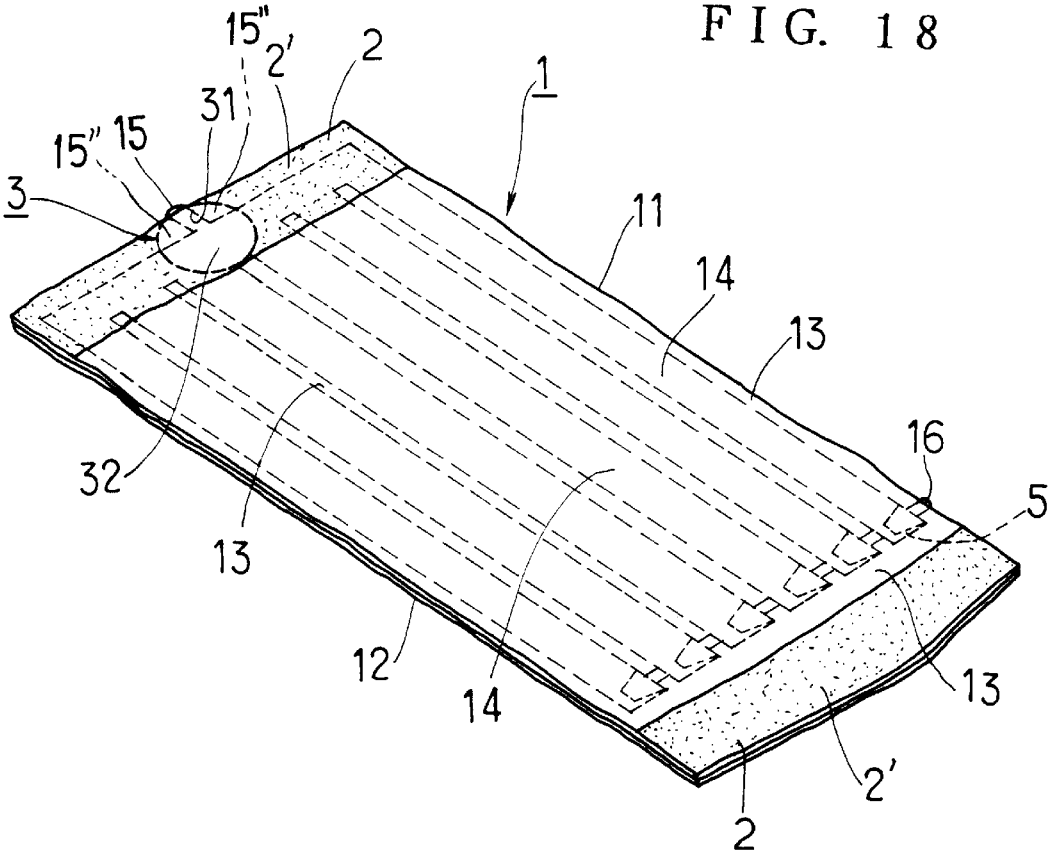
FIG. 18 is a perspective view of an eighth embodiment of the impact resistant wrapping system according to this invention.
Figure 19:
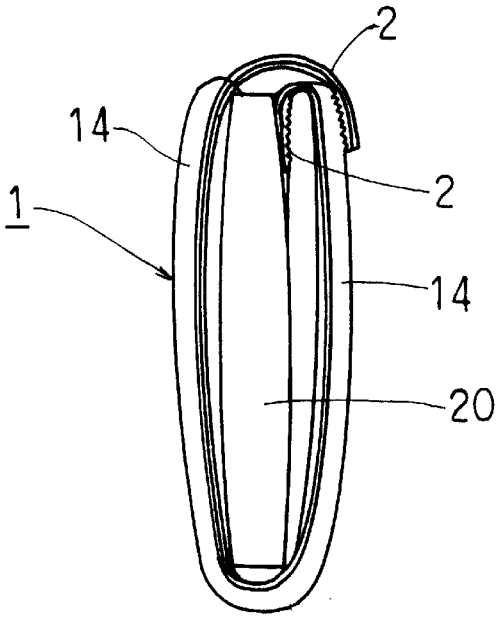
FIG. 19 is a side view of the system of FIG. 18 in use.

FIG. 18 and FIG. 19 show an eighth embodiment of the impact resistant wrapping system according to this invention. In this embodiment, an intake tap 3 having a narrow inlet 31, which leads to the intake port 15 and a spreading round outlet 32 is formed in common with the plurality of wall chambers 14 so as to disperse the gas 10 toward the wall chambers 14 from the intake port 15 through spreading portions 15". The adherent connecting means 2 are each formed of a pressure-sensitive adhesive 2' covered with a releasing sheet.

According to this embodiment, the article 20 to be protected can be wrapped within the wrapping body folded like an envelope. Besides, the wrapping system in its folded state can be made thin due to a decreased number of the intake tap 3 and the thin connecting means 2 having such a simple structure as described.

Figure 20:
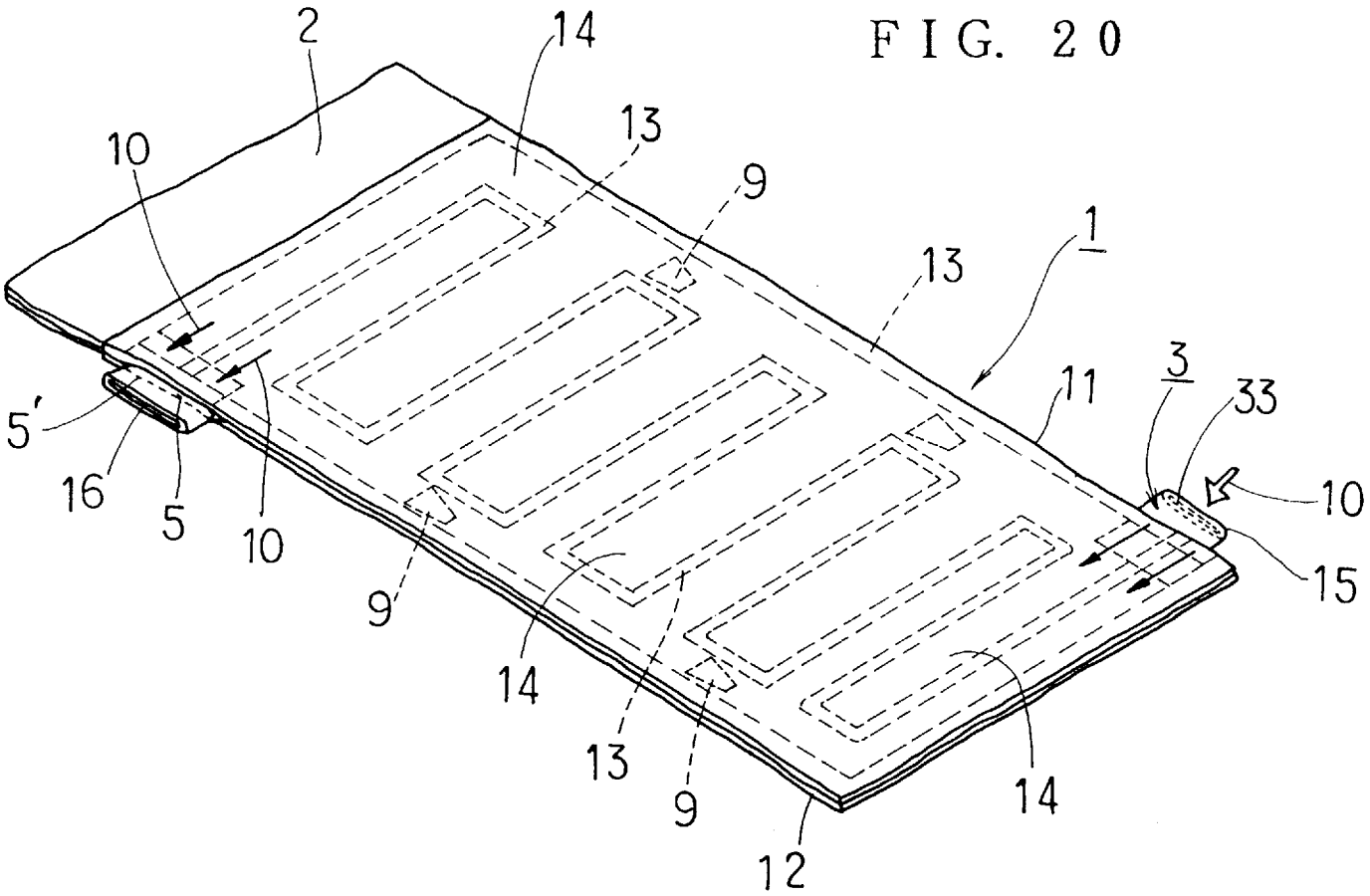
FIG. 20 is a perspective view of a ninth embodiment of the impact resistant wrapping system according to this invention.
Figure 21:
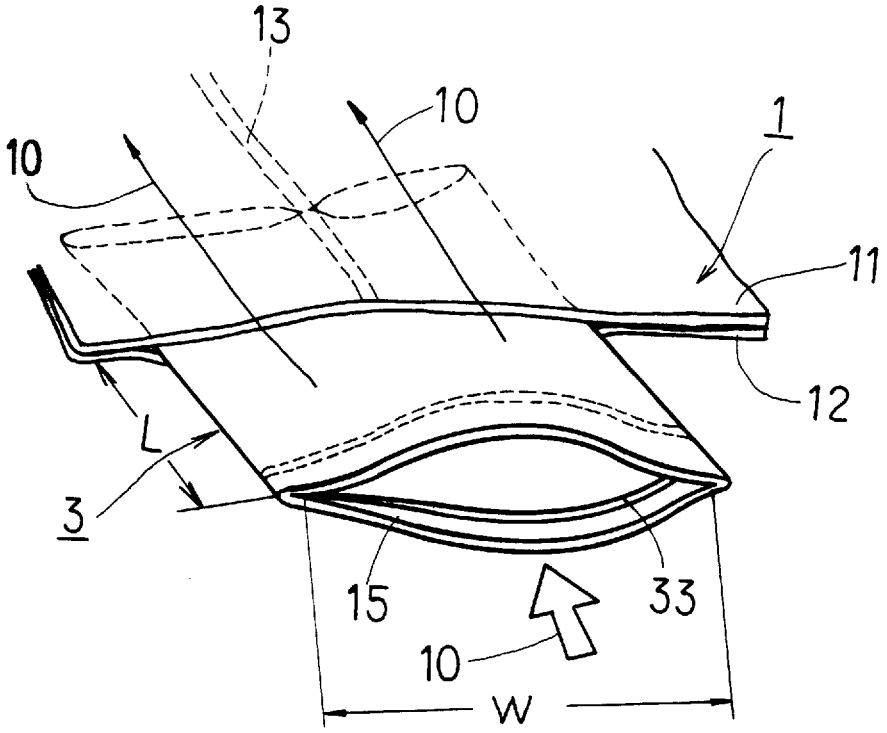
FIG. 21 is an enlarged perspective view showing a principal portion of the system of FIG. 20.

FIG. 20 and FIG. 21 show a ninth embodiment of the impact resistant wrapping system according to this invention. In this embodiment, the seal portion 13 for dividing the inner space of the sheetlike wrapping body 1 into two wall chambers 14 is arranged in a continuous zigzag. Each wall chamber 14 elongated in zigzag is subdivided into generally U-shaped compartments by intermediary taps 9. Correspondingly, the intake tap 3 and exhaust tap 5 are provided with seals 33 and 5' capable of opening and closing and shaped generally in a fork. The protrusion length L and width W of each of the intake tap 3 and exhaust tap 5 are on the order of several millimeters to some tens of millimeters.

According to this embodiment, the gas 10 filled in the wrapping body can be discharged by pressing the inflated wall chambers 14 without using the exhaust pipe 6 as described above. The intermediary taps 9 in this embodiment have the function of the exhaust tap 5. Furthermore, since the width W of the intake port 15 is large, the gas 10 can be easily injected.

Figure 22:
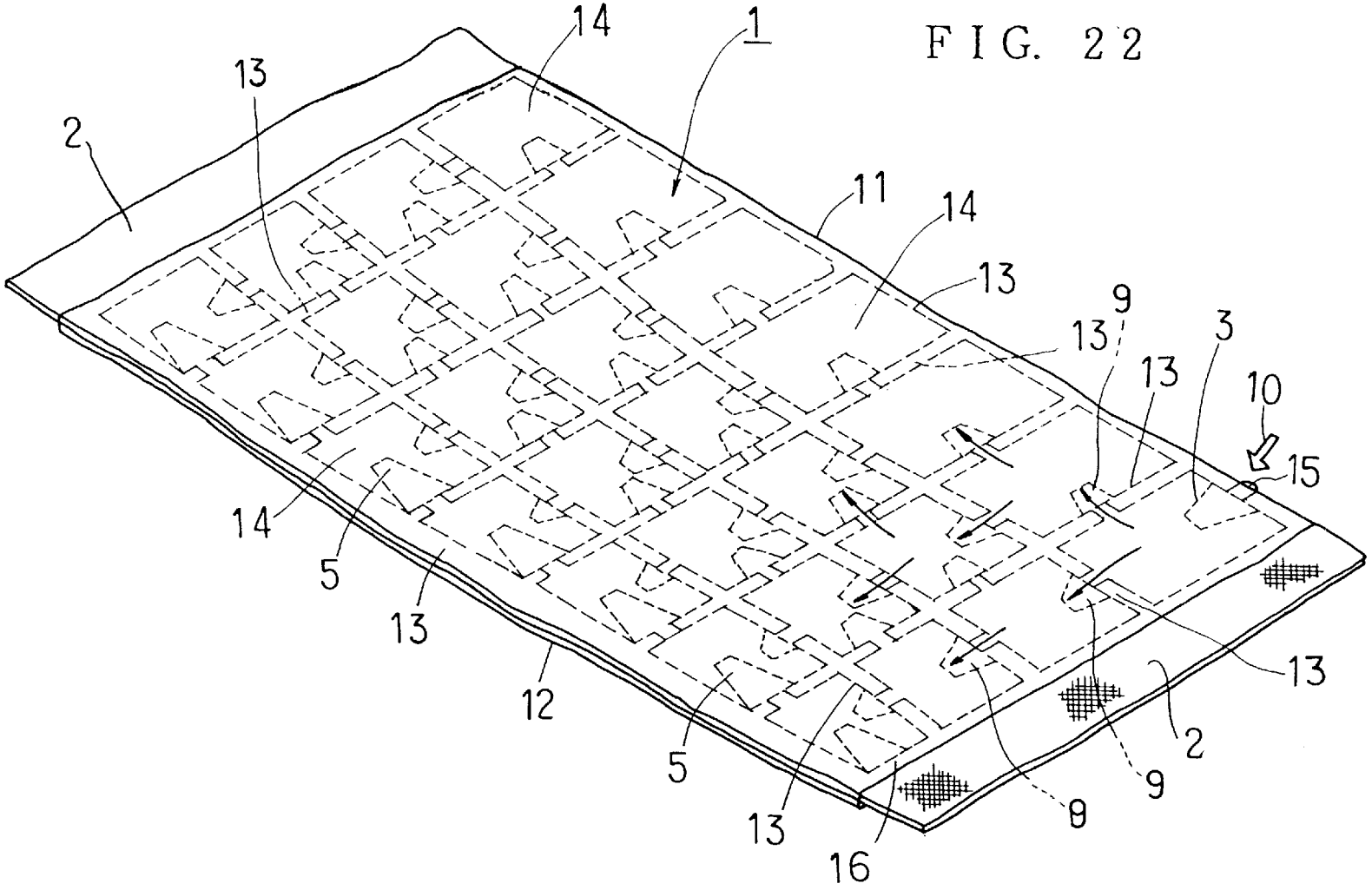
FIG. 22 is a perspective view of a tenth embodiment of the impact resistant wrapping system according to this invention.

FIG. 22 shows a tenth embodiment of the impact resistant wrapping system according to this invention. This embodiment includes a lattice-shaped seal portion 13 to subdivide the wall chambers 14 as found in the first embodiment. The subdivided wall chambers 14 are partially connected to laterally adjacent wall chambers 14, so that only one intake tap 3 is sufficient for injecting the gas.

According to this invention, since the surface of the wrapping body formed by the inflated wall chambers 14, it comes in contact with the article 20 to be protected in a small wave form, thus increasing the function of absorbing shocks. By using intermediary taps 9 for partially connecting the adjacent wall chambers 14 to one another, even if a part of the wall chambers is broken, the gas 10 can be prevented from leaking from other wall chambers.

Figure 23:
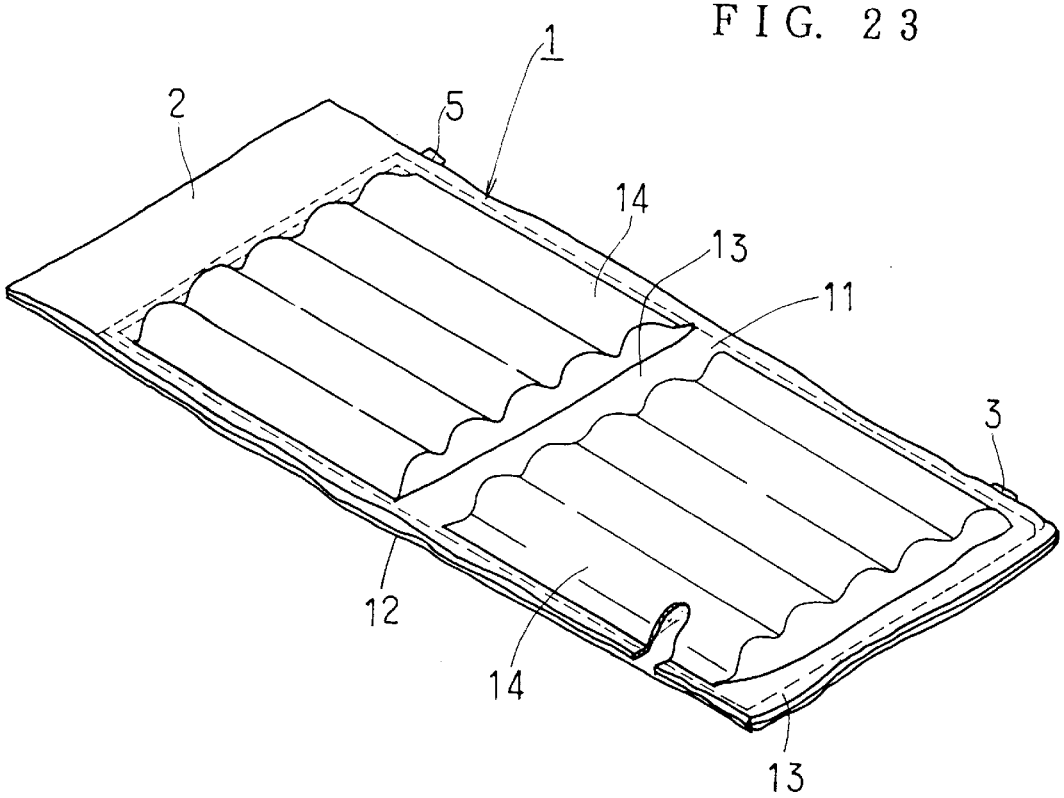
FIG. 23 is a perspective view of an eleventh embodiment of the impact resistant wrapping system according to this invention.
Figure 24:
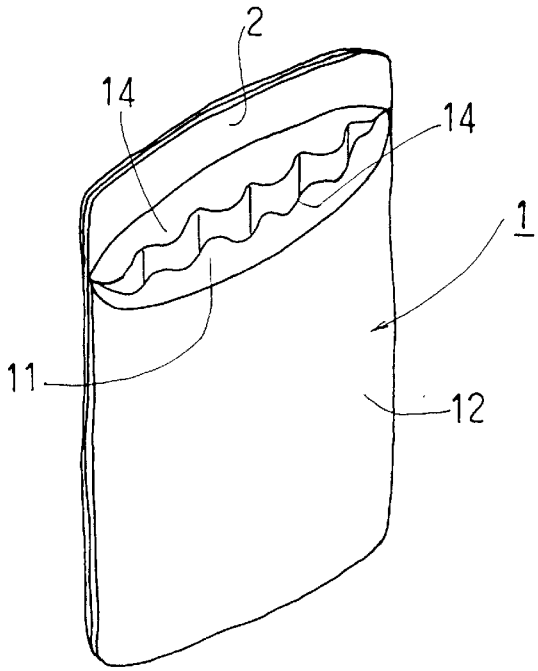
FIG. 24 is a perspective view of the system of FIG. 23 in use.

FIG. 23 and FIG. 24 show an eleventh embodiment of the impact resistant wrapping system according to this invention. One of the flexible wall members 11 and 12 in this embodiment is made of relatively thin material forming wavy-shaped or semicylindrical ridges, and the other wall member is made relatively thick. Thus, wall chambers 14 are each made slender, but generally interconnected with one another.

The wrapping system of this embodiment may be provided with at least one set of intake tap 3 and exhaust tap 5. By using one series of the wall members 11 and 12, which are each formed in a wavy or semicylindrical shape, as an inside surface coming into face contact with the article to be wrapped, the outside surface of the wrapping system can be made flat.

Figure 25:
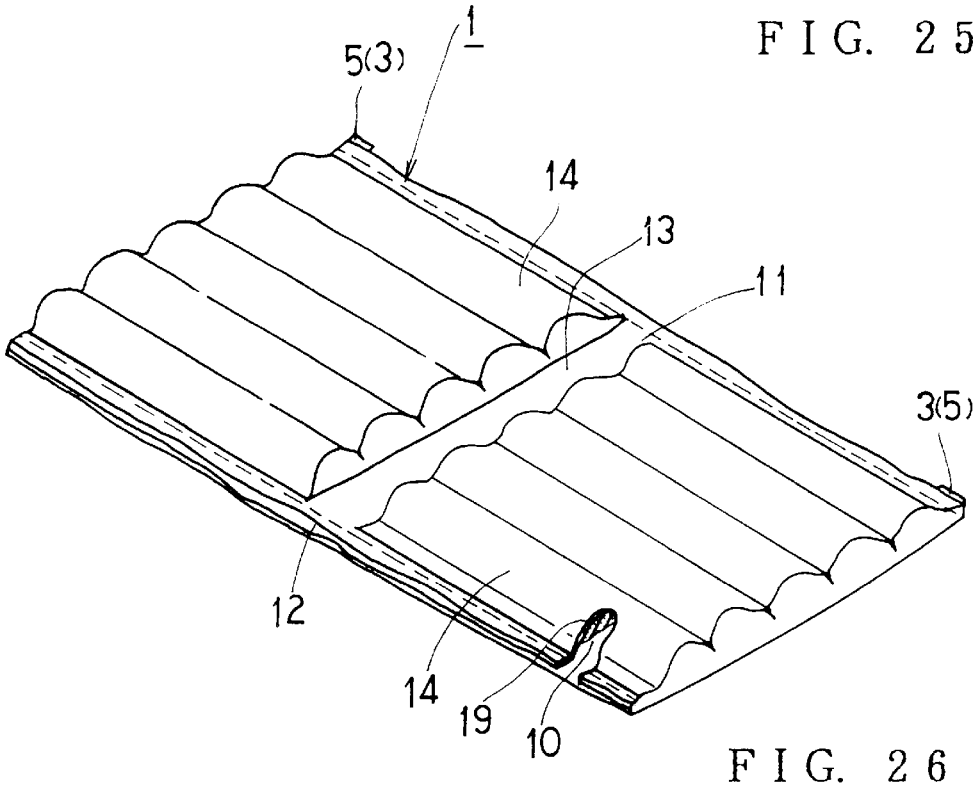
FIG. 25 is a perspective view of a twelfth embodiment of the impact resistant wrapping system according to this invention.
Figure 26:
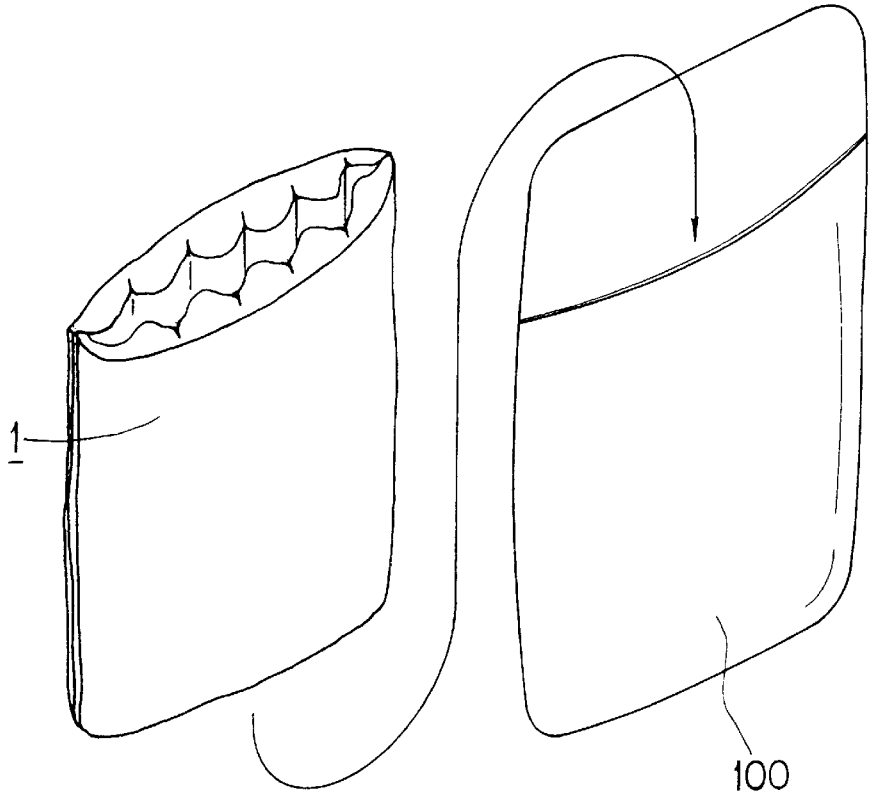
FIG. 26 is a perspective view showing the system of FIG. 25 in use.

FIG. 25 and FIG. 26 show a twelfth embodiment of the impact resistant wrapping system according to this invention. This embodiment is the same as the aforesaid eleventh embodiment except for the connecting means 2 in the eleventh embodiment. This wrapping system can be placed inside an envelope 100.

According to this embodiment, the wrapping system can be suitably used as an inner package.

Figure 27:
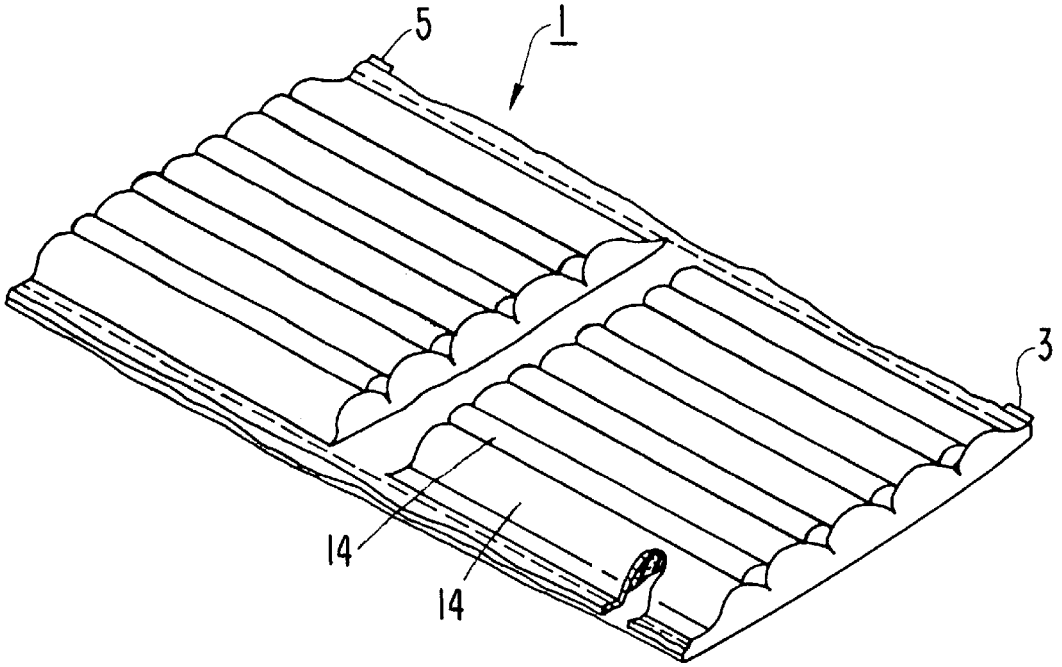
FIG. 27 is a perspective view of a thirteenth embodiment of the impact resistant wrapping system according to this invention.

FIG. 27 shows a thirteenth embodiment of the impact resistant wrapping system according to this invention. This embodiment has the flexible wall members 11 or wall members 12, which are each formed in a semicylindrical shape to assume a wavy surface as a whole, and small wavy members each disposed between the adjacent wavy wall members, so as to have a double wavy structure. In this embodiment, the surface defined by the wall members on the other side than that on which the wavy wall members are formed is made flat. The wall chambers 14 thus formed is each made slender, but generally interconnected with one another.

According to this embodiment, the interior surface formed by the double wavy structure is made smooth and flat.

Figure 28:
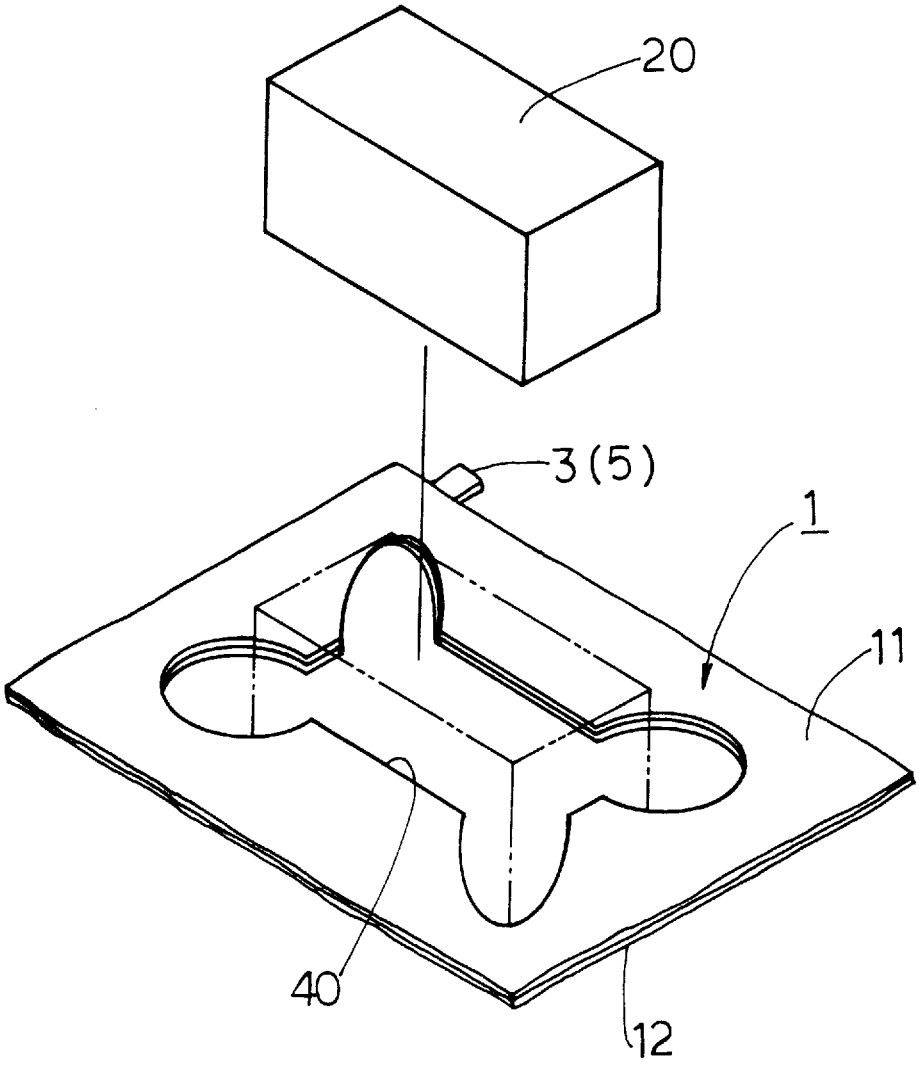
FIG. 28 is a perspective view of a fourteenth embodiment of the impact resistant wrapping system according to this invention.

FIG. 28 shows a fourteenth embodiment of the impact resistant wrapping system according to this invention. The wrapping body 1 of this embodiment is provided in its central portion with a relatively large cutout 40.

According to this embodiment, since an article 20 to be wrapped is held by fitting the whole or one part such as a corner of the article into the cutout 40, the article 20 can be protected from shock and steadily wrapped without using a specific retaining means such as the element 2 in the foregoing embodiments.

Figure 29:
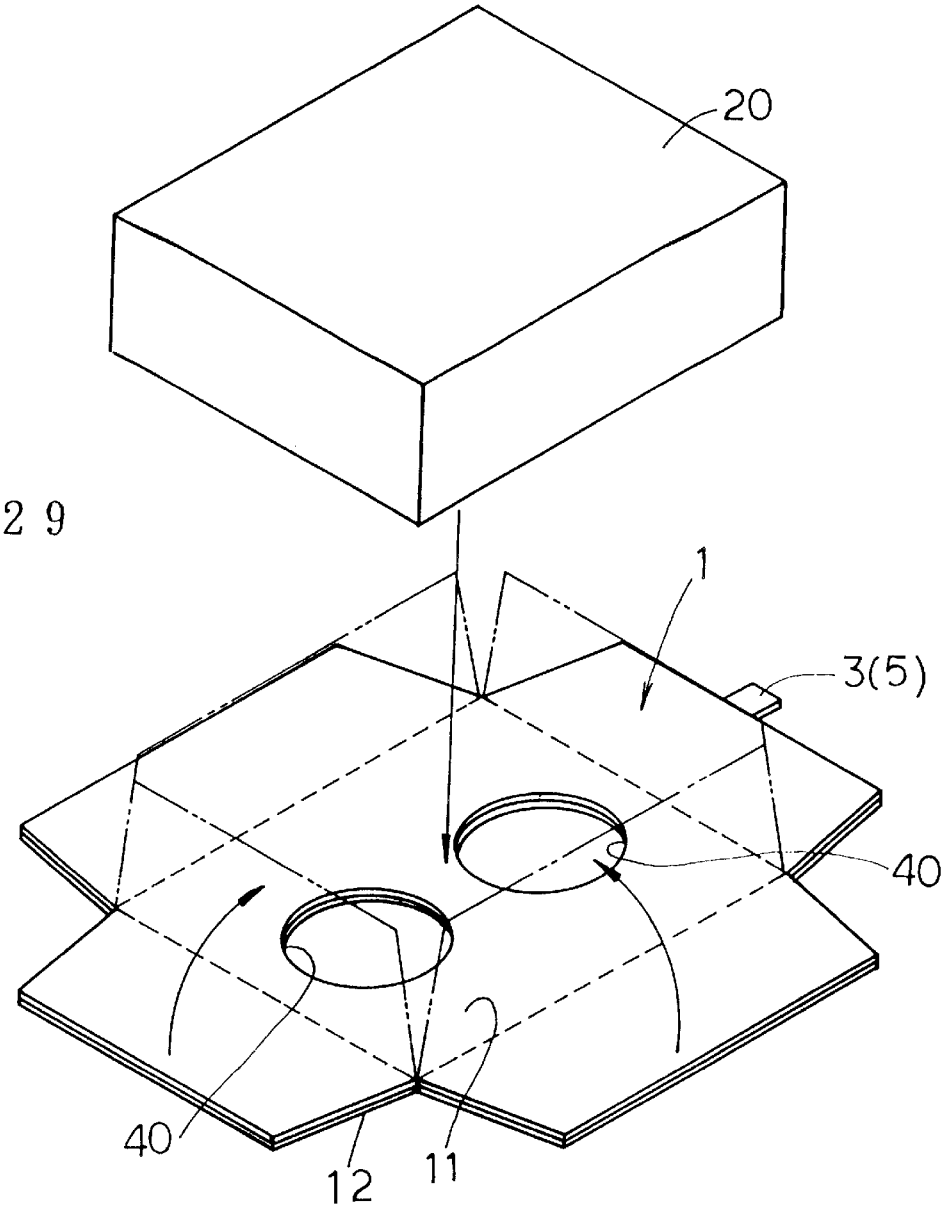
FIG. 29 is a perspective view of a fifteenth embodiment of the impact resistant wrapping system according to this invention.

FIG. 29 shows a fifteenth embodiment of the impact resistant wrapping system according to this invention. The wrapping body 1 of this embodiment is provided in its central portion with relatively small cutouts 40.

According to this invention, when packing an article 20 to be wrapped within an enclosure formed by the sheetlike wrapping body 1, the cutout 40 is used as a non-contact means so that the article 20 fitted into the cutout 40 can be prevented from coming into touch with the wrapping body 1, or it serves as a peephole for observing the article contained in the wrapping system.

Figure 30:
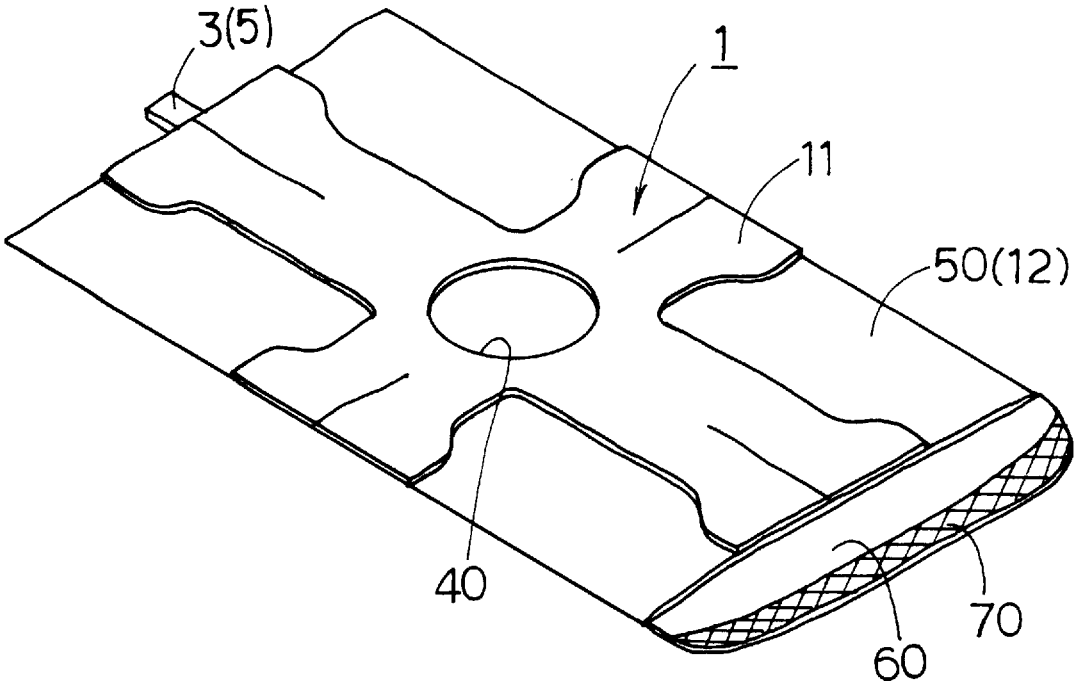
FIG. 30 is a perspective view of a sixteenth embodiment of the impact resistant wrapping system according to this invention.
Figure 31:
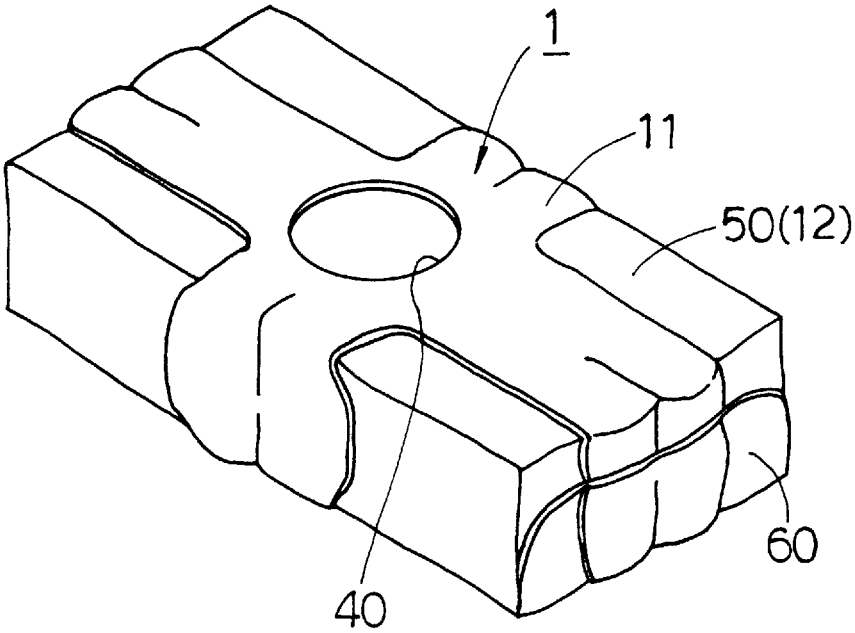
FIG. 31 is a perspective view of the system of FIG. 30 in use.

FIG. 30 and FIG. 31 show a sixteenth embodiment of the impact resistant wrapping system according to this invention. The sheetlike wrapping body 1 in this embodiment is integrated with a bag 50. That is, one of the flexible wall members, 12, of the sheetlike wrapping body 1 is common to the bag 50. The bag 50 has a lid 60 with an adhesive 70 for sealing the opening of the bag.

According to this embodiment, an article 20 to be protected can be wrapped only by being put into the bag 50 and closing the bag with the lid 60. Otherwise, the bag 50 may be stuffed with cushioning material, so that the resistant wrapping system of the invention can be used as a filler or packing material, but not as a means for wrapping the article 20.

Figure 32:
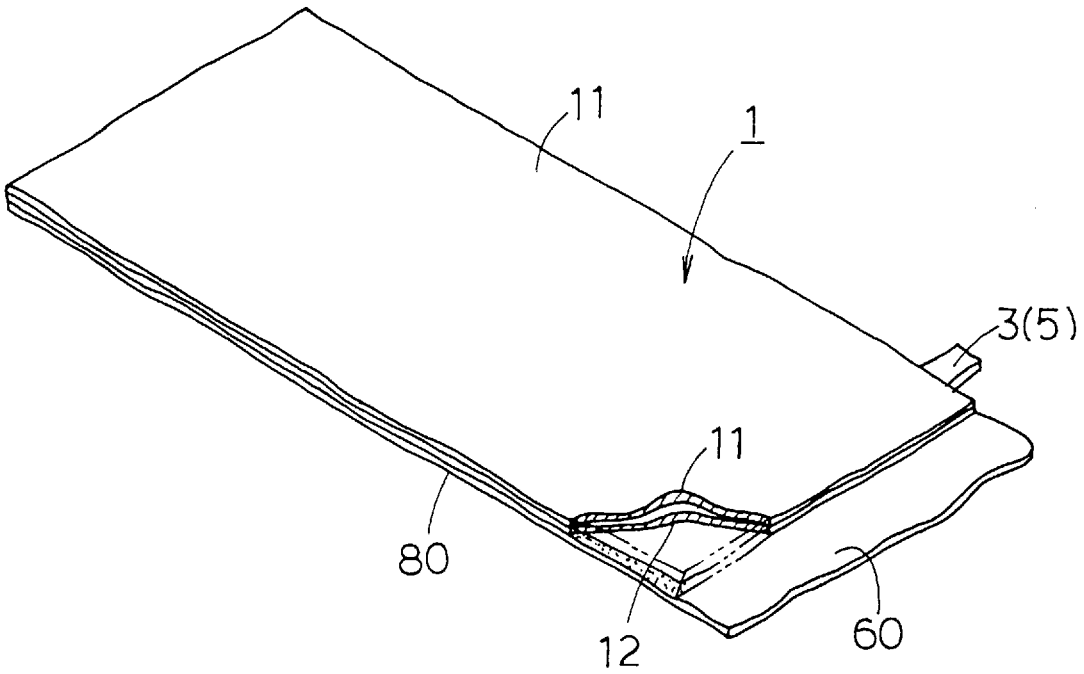
FIG. 32 is a perspective view of a seventeenth embodiment of the impact resistant wrapping system according to this invention.

FIG. 32 shows a seventeenth embodiment of the impact resistant wrapping system according to this invention. In this embodiment, the sheetlike wrapping body 1 is laminated with a sheet 80 having a lid 60 and sealed along its fringe portion so as to form an envelope.

This embodiment has the same function and effect as the aforementioned sixteenth embodiment.

Figure 33:
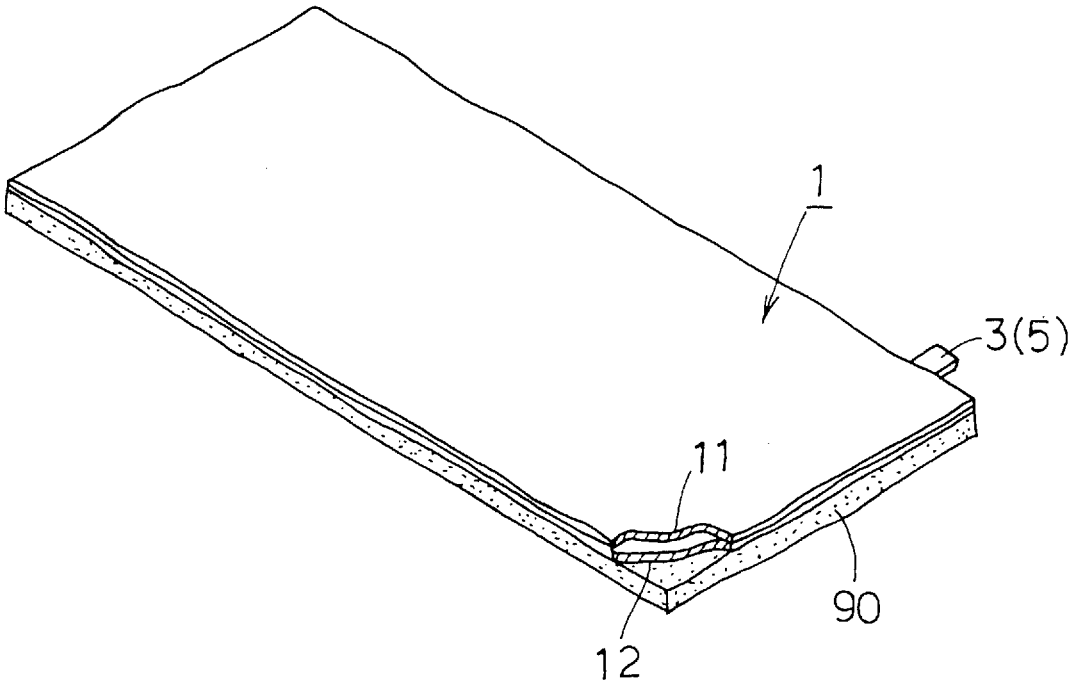
FIG. 33 is a perspective view of an eighteenth embodiment of the impact resistant wrapping system according to this invention.

FIG. 33 shows an eighteenth embodiment of the impact resistant wrapping system according to this invention. In this embodiment, the sheetlike wrapping body 1 is attached to a foam cushion sheet 90.

The impact resistant wrapping system of this embodiment is suitably used as a cushion means, but not as a means for wrapping the article 20.

Figure 34:
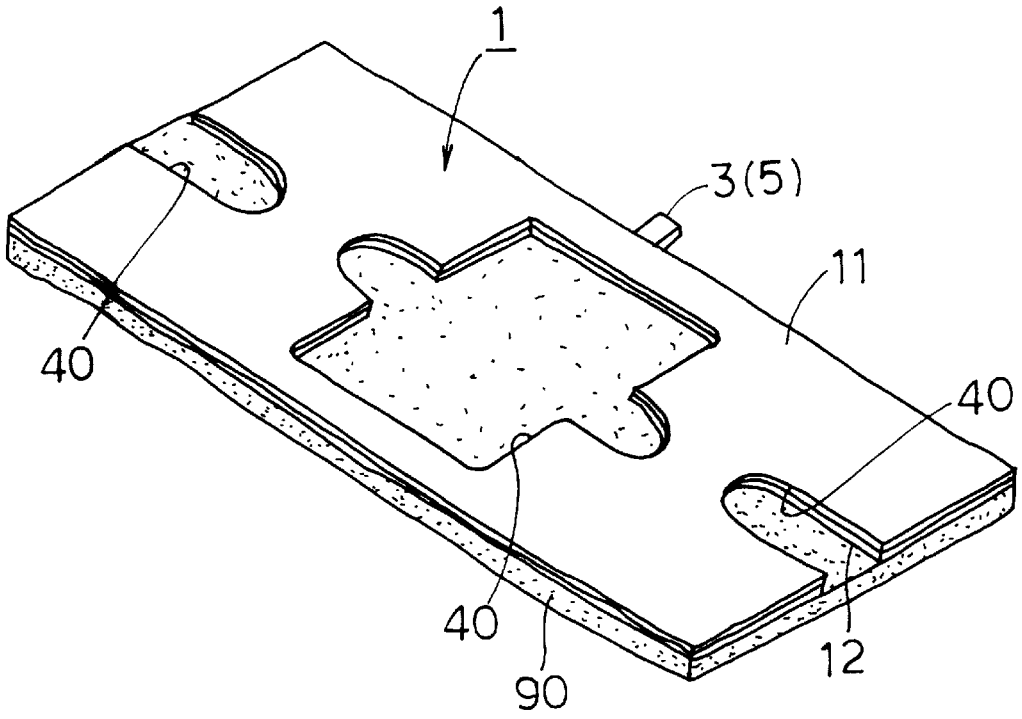
FIG. 34 is a perspective view of a nineteenth embodiment of the impact resistant wrapping system according to this invention.

FIG. 34 shows a nineteenth embodiment of the impact resistant wrapping system according to this invention. The sheetlike wrapping body 1 of this embodiment is formed by letting the wrapping body 1 of the aforenoted eighteenth embodiment have cutouts 40.

According to this embodiment, an article 20 wrapped by the wrapping system is prevented from coming in touch with the sheetlike wrapping body 1 by means of the cutouts 40. In this embodiment, other cushion means may be fitted into vacant cutouts 40 in wrapping the article.

Figure 35:
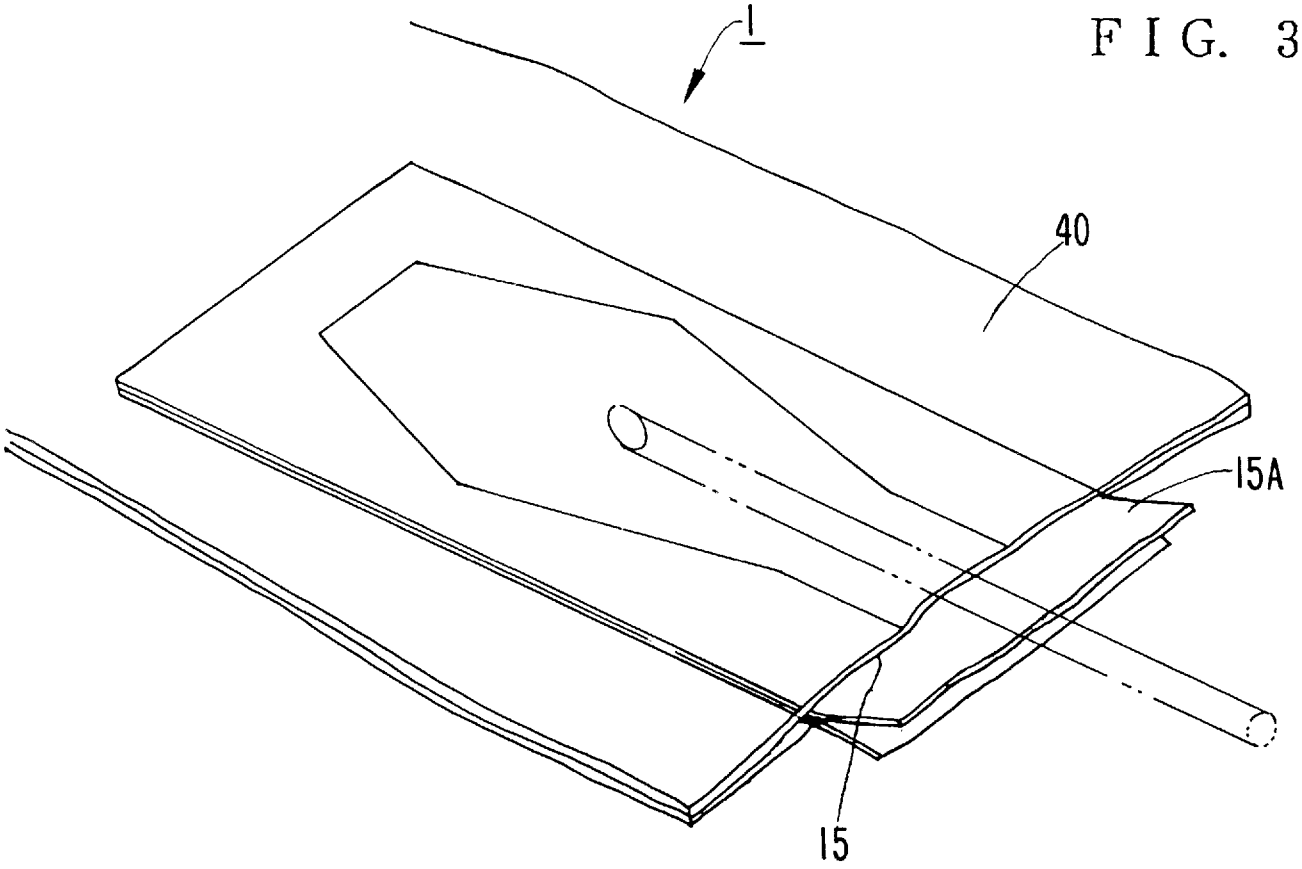
FIG. 35 is a perspective view of a twentieth embodiment of the impact resistant wrapping system according to this invention.

FIG. 35 shows a twentieth embodiment of the impact resistant wrapping system according to this invention, wherein a cutout 40 extends from an intake port 15 to ribs 15A of the sheetlike wrapping body 1.

According to this embodiment, an article 20 wrapped by the wrapping system is prevented from coming in touch with the sheetlike wrapping body 1 by means of the cutout 40. In this embodiment, other cushion means may be fitted into the cutout 40 along with the article.

Figure 36:
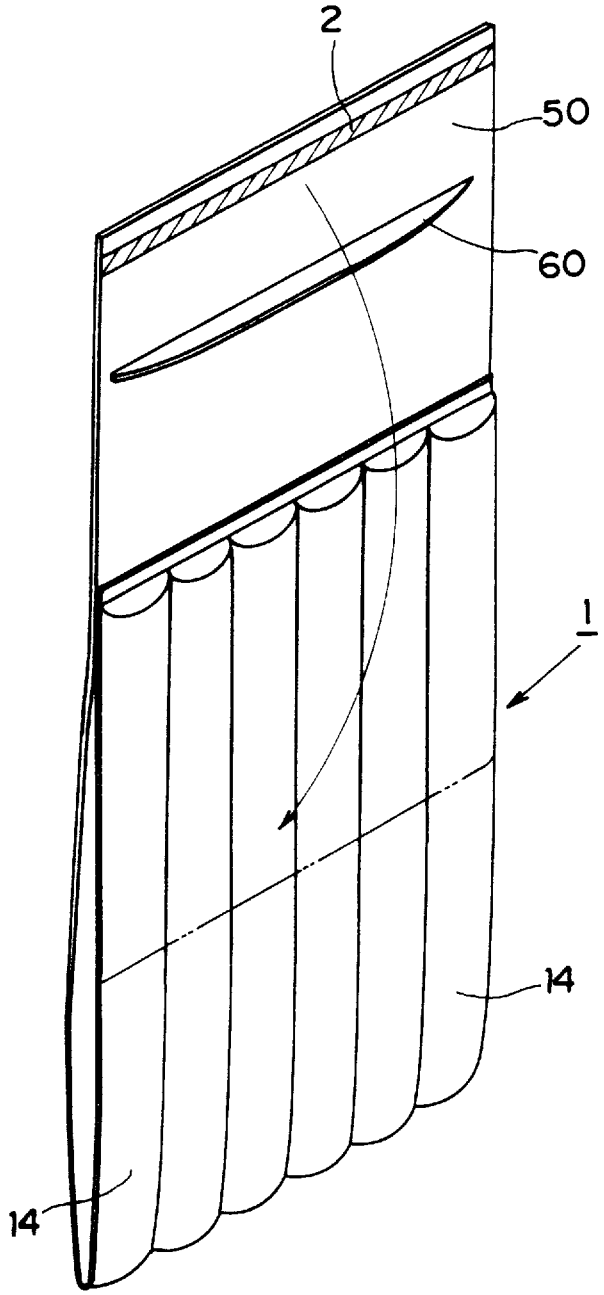
FIG. 36 is a perspective view of a twenty-first embodiment of the impact resistant wrapping system according to this invention.
Figure 37:
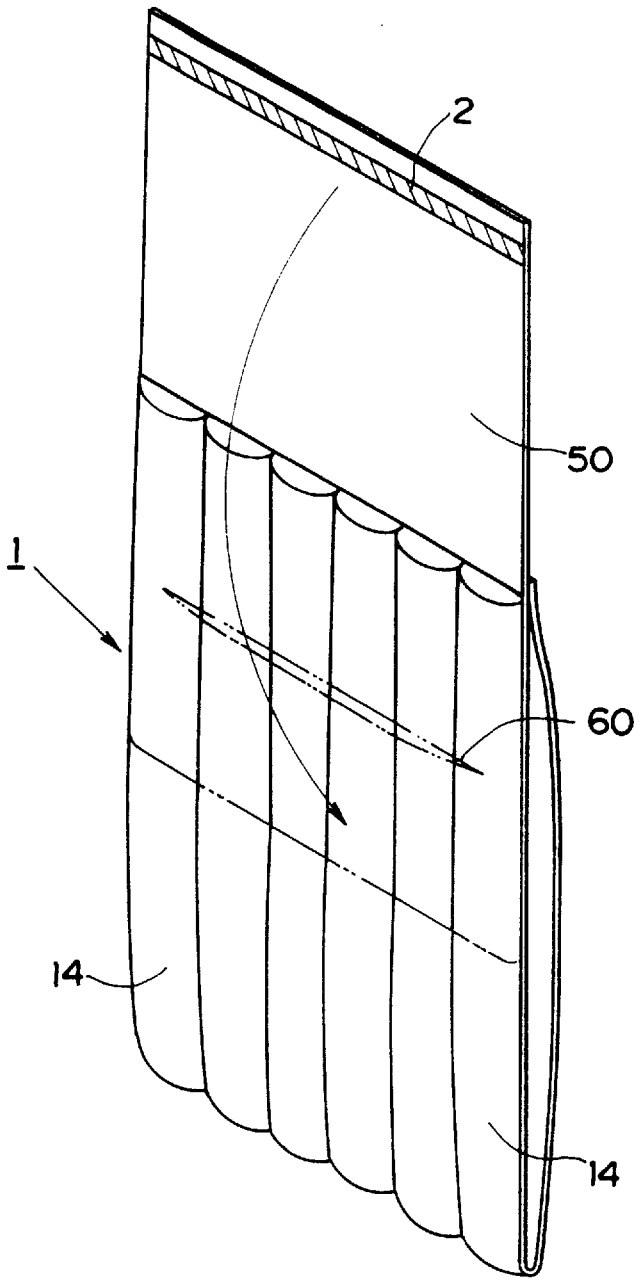
FIG. 37 is a rear view of FIG. 36.

FIG. 36 and FIG. 37 show a twenty-first embodiment of the impact resistant wrapping system according to this invention. The wrapping system of this embodiment is formed by folding the sheetlike wrapping body 1 into two, and joining both ends of the folded wrapping body to each other, so as to assume a bag shape. To one end of the sheetlike wrapping body 1, there is joined a lid member 50. The lid member 50 is formed like a bag and has an open slit 60. Repeatedly usable connecting means 2 formed of adhesive are attached one onto either surface (opposite sides of the folded wrapping body 1) of the lid member 50.

According to this embodiment, an article 20 to be protected can be contained in the bag-shaped sheetlike wrapping body 1. If the article 20 is thin, it may be admitted into the bag-shaped lid member 50 through the open slit 60. The lid member 50 folded back onto the sheetlike wrapping body 1 and fastened by the connecting means 2 serves to reinforce the wrapping body 1. Likewise, the lid member 50 thus folded back and fastened onto the wrapping body 1 for accommodating the thin article 20 increases the cushioning effect brought about by the wall chambers 14.

According to the purpose for which the article to be protected is transported or carried, a message card, a list for goods to be transported or the like may be inserted into the open slit 60. Furthermore, since the lid member 50 can be folded onto either side of the sheetlike wrapping body, different address cards may be attached one onto either side of the lid member 50, so that the wrapping system can be used as a communication means to be sent between two places.

As the other measure than the aforesaid embodiment, the intake tap 3 may be omitted by using the exhaust pipe 6 to be inserted through the exhaust tap 5 for introducing the gas 10 into the wall chambers 14 in the sheetlike wrapping body 1.

Moreover, the intake tap and exhaust tap 5 may be changed to those used in the other embodiments as specified above.

Besides, according to the usage, the wrapping system of the invention can be used as cushioning means for a floor cushion, mattress and so on.

INDUSTRIAL APPLICABILITY

As is apparent from the foregoing, since the impact resistant wrapping system according to the present invention has the partitioned wall chambers inflatable with gas, it can be folded or bent into any shape and any size in conformity with the shape and size of an article to be protected. Since the gas filled in the wall chambers can be continuously released through the exhaust taps arranged in line, the wrapping body inflated with gas can easily be deflated, thus resuming its original sheetlike shape, so that versatility and repetitious usability of the wrapping system can be heightened.

Since the wrapping system of the invention has a simple structure including the intake tap and exhaust taps, it can easily be manufactured at a low cost. Furthermore, since the wrapping system including the intake tap and exhaust taps is made thin and flat, it is advantageous in tucking away and storing.

In addition, the gas filled in the wrapping system can be swiftly injected into and released from the wall chambers with a simple operation. Moreover, since the gas intake and exhaust can be carried out through a plurality of intake and exhaust passages, quick inflation and deflation of the wrapping body can be accomplished.

Besides, since an article to be protected can be admitted into a bag-like wrapping body, the article can easily be wrapped. The wrapping system of the invention further has an effect of increasing the cushioning effect by incorporating another cushioning material in the bag-like wrapping body.

I claim:

1. An impact resistant wrapping system, comprising:

flexible wall members together forming a wrapping body sheet, said flexible wall members having gas barrier properties;

a plurality of wall chambers formed between said flexible wall members;

at least one intake tap in said wrapping body sheet that is capable of injecting gas into said plurality of wall chambers; and a plurality of exhaust taps in said wrapping body capable of releasing gas from said wall chambers, said plurality of exhaust taps being arranged along at least one line that crosses a plurality of said wail chambers such that an exhaust pipe can be inserted into said exhaust taps, adjacent ones of said plurality of wall chambers can be communicated with one another, and an outermost one of said plurality of wall chambers can be communicated with the outside of said wrapping body sheet, through said plurality of exhaust taps;

wherein said inlet and exhaust taps are formed of flat tubes.

2. The impact resistant wrapping system of claim 1, wherein said flat tubes are made of synthetic resin film.

3. The impact resistant wrapping system of claim 2, and further comprising an exhaust pipe having a peripheral surface with a plurality of pores therein capable of being inserted into successive ones of said plurality of exhaust taps along said at least one line.

4. The impact resistant wrapping system of claim 1, wherein said wrapping body sheet has an outer surface thereof formed with a cutout portion.

5. The impact wrapping system of claim 1, wherein said wrapping body sheet forms a bag.

6. An impact resistant wrapping system, comprising:

flexible wall members together forming a wrapping body sheet, said flexible wall members having gas barrier properties;

a plurality of closely partitioned wall chambers formed between said flexible wall members and passages communicating at least some of said wall chambers with one another;

at least one intake tap in said wrapping body sheet that is capable of injecting gas into said plurality of wall chambers;

intermediary taps disposed between at least some of said wall chambers at said passages thereof so as to be able to communicate said wall chambers with one another through said passages; and at least one exhaust tap in said wrapping body capable of releasing gas from said wall chambers, such that adjacent ones of said plurality of wall chambers can be communicated with one another, and an outermost one of said plurality of wall chambers can be communicated with the outside of said wrapping body sheet, through said intermediary taps, said passages and said at least one exhaust tap.

7. The impact resistant wrapping system of claim 6, wherein said wrapping body sheet has an outer surface thereof formed with a cutout portion.

8. The impact wrapping system of claim 6, wherein said wrapping body sheet forms a bag.

9. An impact wrapping system comprising:

flexible wall members together forming a wrapping body sheet, said flexible wall members having gas barrier properties;

a plurality of wall chambers formed between said flexible wall members and positioned next to one another in the direction of said sheet;

passages formed between said flexible wall members communicating said plurality of wall chambers with the exterior thereof and with each other;

a plurality of one way check valves formed of flat tubes controlling the flow of gas through said passages, said plurality of one way check valves including at least one inlet valve, at least one outlet valve and valves controlling said passages communicating said plurality of wall chambers with each other.

10. The impact wrapping system of claim 9, wherein said at least one inlet valve comprises a respective one of said one way check valves for each of said wall chambers and said at least one outlet valve and said valves controlling said passages comprise an additional one of said one way check valves for each of said wall chambers.

11. The impact wrapping system of claim 9, wherein said flexible wall members comprise films that are sealed together along outer edges thereof and at seal portions that define said wall chambers between said films.

12. The impact wrapping system of claim 11, wherein said one way check valves comprise film tubes that extend into respective said wall chambers to free ends in directions corresponding to directions of the flow of gas through said one way check valves.

13. The impact wrapping system of claim 9, wherein said one way check valves comprise a plurality of valves disposed along a line that crosses a plurality of said wall chambers.

14. The impact wrapping system of claim 9, wherein said at least one inlet valve comprises a plurality of inlet valves communicating with respective said wall chambers and with a common intake port.

15. The impact wrapping system of claim 14, wherein wrapping body sheet forms a T-shaped sheet capable of being folded into the shape of a box.

16. The impact wrapping system of claim 9, wherein said at least one inlet valve comprises a plurality of inlet valves communicating with respective said wall chambers and with a means for providing gas under pressure to said plurality of inlet valves.

17. The impact wrapping system of claim 9, wherein said at least one inlet valve is serially communicated with a plurality of said wall chambers, said passages, said valves controlling the flow of gas through said passages and said at least one outlet valve.

18. The impact wrapping system of claim 9, wherein said at least one inlet valve comprises a plurality of inlet valves communicating with respective said wall chambers, said at least one outlet valve comprises a plurality of valves disposed along a line that crosses a plurality of said wall chambers, and said one way check valves comprise film tubes that extend into respective said wall chambers to free ends in directions corresponding to directions of the natural flow of gas through said one way check valves.

19. The impact wrapping system of claim 18, and further comprising an exhaust pipe having a peripheral surface with a plurality of pores therein capable of being inserted into successive ones of said plurality of exhaust taps along said at least one line in the directions of the natural flow of gas to allow gas to flow in the opposite direction to be exhausted.

20. The impact wrapping system of claim 9, wherein said wrapping body sheet has an opening therein capable of receiving an article to be wrapped.

* * * * *